US008465894B2

(12) United States Patent
Yamanaka et al.

(10) Patent No.: US 8,465,894 B2
(45) Date of Patent: Jun. 18, 2013

(54) RED TONER FOR ELECTROSTATIC IMAGE DEVELOPMENT, DEVELOPER FOR ELECTROSTATIC IMAGE DEVELOPMENT, TONER SET FOR ELECTROSTATIC IMAGE DEVELOPMENT, DEVELOPER SET FOR ELECTROSTATIC IMAGE DEVELOPMENT AND IMAGE FORMING APPARATUS

(75) Inventors: Kiyohiro Yamanaka, Kanagawa (JP); Satoshi Yoshida, Kanagawa (JP); Masanobu Ninomiya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 813 days.

(21) Appl. No.: 12/563,656

(22) Filed: Sep. 21, 2009

(65) Prior Publication Data

US 2010/0183965 A1 Jul. 22, 2010

(30) Foreign Application Priority Data

Jan. 22, 2009 (JP) ..... 2009-011554

(51) Int. Cl.
*G03G 9/09* (2006.01)

(52) U.S. Cl.
USPC ..... 430/104; 430/107.1; 430/108.8; 430/109.4

(58) Field of Classification Search
USPC ..... 430/104, 107.1, 108.8, 109.4
See application file for complete search history.

(56) References Cited

U.S. PATENT DOCUMENTS

| | | | | |
|---|---|---|---|---|
| 6,667,140 | B2 * | 12/2003 | Tosaka et al. | 430/108.23 |
| 6,686,112 | B2 * | 2/2004 | Teshima et al. | 430/110.1 |
| 6,808,855 | B2 * | 10/2004 | Ayaki et al. | 430/110.2 |
| 2003/0162116 | A1 * | 8/2003 | Katsuta et al. | 430/108.23 |
| 2004/0013958 | A1 | 1/2004 | Ayaki et al. | |
| 2005/0095516 | A1 * | 5/2005 | Ohmura et al. | 430/45 |
| 2005/0176853 | A1 * | 8/2005 | Hopper et al. | 523/333 |
| 2005/0238986 | A1 * | 10/2005 | Itoh | 430/110.2 |
| 2006/0029876 | A1 * | 2/2006 | Nomiya et al. | 430/110.2 |
| 2006/0051686 | A1 * | 3/2006 | Ide et al. | 430/18 |
| 2006/0160009 | A1 * | 7/2006 | Padunchwit et al. | 430/108.23 |
| 2006/0177759 | A1 * | 8/2006 | Tsujino et al. | 430/137.15 |
| 2008/0153027 | A1 * | 6/2008 | Veregin et al. | 430/113 |
| 2008/0181647 | A1 | 7/2008 | Tomizawa | |

FOREIGN PATENT DOCUMENTS

| | | | |
|---|---|---|---|
| JP | 2004070005 | * | 3/2004 |
| JP | A-2004-70209 | | 3/2004 |
| JP | A-2008-107803 | | 5/2008 |

OTHER PUBLICATIONS

Machine English language translation of JP 2004070005 Mar. 2004.*

* cited by examiner

*Primary Examiner* — Hoa V Le
(74) *Attorney, Agent, or Firm* — Oliff & Berridge, PLC

(57) ABSTRACT

A red toner for electrostatic image development, includes: a binder resin; a coloring agent; and a release agent, wherein the red toner for electrostatic image development satisfies the following formulae:

$$0.3<ID<1.2$$

$$5°<A<35°$$

wherein ID represents an image density when a first image is formed on a recording material with a toner loaded amount of 4.0 g/m$^2$ of the red toner; and A represents a hue angle of the first image expressed by an L*a*b* color coordinate space, provided that a hue angle of 0° is on the a*+ axis and a hue angle of 90° is on the b*+ axis.

16 Claims, 1 Drawing Sheet

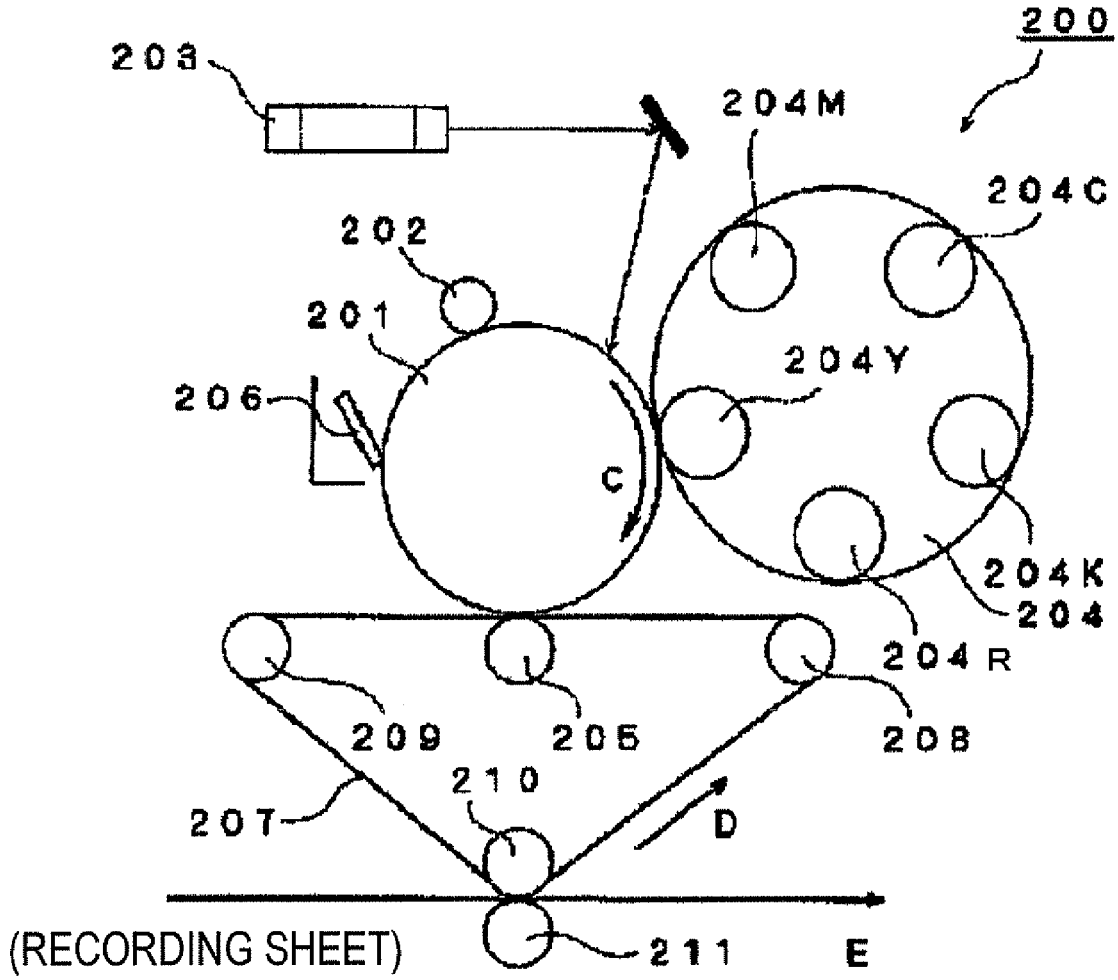
200
203
204M
204C
202
201
204Y
206
C
204K
204
204R
209
205
208
210
207
D
(RECORDING SHEET)
211
E

RED TONER FOR ELECTROSTATIC IMAGE DEVELOPMENT, DEVELOPER FOR ELECTROSTATIC IMAGE DEVELOPMENT, TONER SET FOR ELECTROSTATIC IMAGE DEVELOPMENT, DEVELOPER SET FOR ELECTROSTATIC IMAGE DEVELOPMENT AND IMAGE FORMING APPARATUS

CROSS-REFERENCE TO RELATED APPLICATION

This application is based on and claims priority under 35 USC 119 from Japanese Patent Application No. 2009-011554 filed Jan. 22, 2009.

BACKGROUND

1. Technical Field

The present invention relates to a red toner for electrostatic image development, a developer for electrostatic image development, a toner set for electrostatic image development, a developer set for electrostatic image development and an image forming apparatus.

2. Related Art

At present, a method of visualizing image information through an electrostatic image, such as electrophotographic process, is being utilized in various fields. In the electrophotographic process, for example, an electrostatic latent image is formed on an image holding member via charging and exposure steps (latent image forming step), the electrostatic latent image is developed with a developer for electrostatic latent image development (hereinafter sometimes simply referred to as a "developer") containing an electrostatic image developing toner (hereinafter sometimes simply referred to as a "toner") (developing step), the developed toner image is primarily transferred onto an intermediate transfer member (primary transfer step), and the toner image transferred onto the intermediate transfer member is secondarily transferred onto a recording material (secondary transfer step) and visualized through a fixing step.

In the electrophotographic process, when forming a full color image, color reproduction is performed using four colors including a combination of yellow, magenta and cyan color materials which are three primary colors, and a black toner. A binary color, for example, a red image, is formed by stacking a yellow toner and a magenta toner in a predetermined ratio.

SUMMARY

According to an aspect of the invention, there is provided a red toner for electrostatic image development, including:

a binder resin;

a coloring agent; and a release agent, wherein the red toner for electrostatic image development satisfies the following formulae:

$$0.3<ID<1.2$$

$$5°<A<35°$$

wherein ID represents an image density when a first image is formed on a recording material with a toner loaded amount of 4.0 g/m$^2$ of the red toner; and A represents a hue angle of the first image expressed by an L*a*b* color coordinate space, provided that a hue angle of 0° is on the a*+ axis and a hue angle of 90° is on the b*+ axis.

BRIEF DESCRIPTION OF THE DRAWING

Exemplary embodiments of the present invention will be described in detail based on the following figure, wherein:

the drawing is a schematic configuration view showing one example of the image forming apparatus according to an exemplary embodiment of the present invention.

DETAILED DESCRIPTION

An exemplary embodiment of the present invention is described below. This exemplary embodiment is one example of the exemplary embodiment for carrying out the present invention, and the present invention is not limited to this exemplary embodiment.

In the case of an image forming method using an intermediate transfer member, at the primary transfer from an image holding member to the intermediate transfer member, the toner image is transferred usually in the order of yellow, magenta, cyan and black. Therefore, at the secondary transfer from the intermediate transfer member to a recording material, the toner is stacked on the recording material in the order of black, cyan, magenta and yellow. In the electrophotographic process, a red image is formed by stacking a yellow toner and a magenta toner in a predetermined ratio, and when the ratio between the yellow toner and the magenta toner varies, this causes a change in the hue. For example, the hue of the formed image may change depending on a recording material on which the image is formed.

For example, in the case where the recording material is plain paper (copier paper in general, whose surface is not subjected to a treatment such as coating), the plain paper is hygroscopic and therefore, the transfer electric field is likely to leak at the transfer, giving rise to reduction of the transfer efficiency. Also, at the secondary transfer, a toner in contact with the intermediate transfer medium is more liable to remain (liable to cause transfer failure), and a yellow toner primarily transferred first to the intermediate transfer member usually remains on the intermediate transfer member, as a result, the yellow toner lacks and the hue of a red image may shift to magenta.

In addition, the plain paper has texture unevenness present on the sheet surface (bumps and dents according to the fiber of sheet) and in a dent of the recording material such as plain paper, the transfer efficiency may change or the toner may penetrate between fibers of the sheet due to heat at the fixing, causing a change in the ratio of the yellow toner to the magenta tone. In an image structure on the recording material, the magenta toner lying in a lower part than the yellow toner usually penetrates into the fiber of sheet and the hue of a red image may shift to yellow. The change in the hue due to penetration is likely to more conspicuously occur in an image having a small loaded amount of the toner. That is, in an image having a large loaded amount of the toner, the toner of the upper image layer lacks due to bad transfer efficiency resulting from a change in the transfer efficiency, whereas in an image having a small loaded amount of the toner, the toner of the lower image layer lacks because of penetration at the fixing, and therefore, a hue shift according to the image density readily occurs on plain paper.

On the other hand, a recording material having a coat layer on the sheet surface, such as coated paper, scarcely causes a change in the transfer efficiency or allows penetration or the like of the toner into the fiber of the sheet, and the hue is less changed than in the plain paper. In this way, a hue shift is likely to occur between the coated paper and a sheet such as plain paper. Accordingly, it is demanded to suppress both magenta-shifting of the hue due to transfer failure and yellow-shifting of the hue due to penetration at the fixing and thereby prevent the hue of an image from changing depending on the kind of a recording material on which the image is formed.

To meet this requirement, a red toner having a light color with a magenta-shifting hue (light red toner) is used in combination at the formation of a red image. Particularly, a red toner (light red toner) having a light color with the hue being more magenta-shifting than the hue of a red image formed with 100% yellow toner and 100% magenta toner that are used together in an image forming apparatus, is used in combination. For example, even when because of formation of an image such that a light red toner comes to the intermediate transfer member side at the primary transfer, a part of the light red toner remains on the intermediate transfer member due to transfer failure at the secondary transfer, the change in the ratio between the yellow toner and the magenta toner is suppressed. Furthermore, even when a part of the magenta toner as a lower layer penetrates between fibers of a recording material at the fixing and the hue of the image is shifted to yellow, since a light red toner having a magenta-shifting hue is stacked thereon, the hue is corrected.

In the case of using a light color toner having the same color as a red image formed with 100% yellow toner and 100% magenta toner, the shifting to yellow of the image is not corrected. In the case of using a dark red toner, in a region with a small loaded amount of the toner, neither the change in the hue nor the worsening of the graininess is suppressed.

Also, the toner contains a crystalline resin as the binder resin, particularly, at least a magenta toner contains a crystalline resin as the binder resin, whereby suppression of the change in the hue is more improved. Because, melting the crystalline resin at the fixing of the toner requires a crystal melting heat but compared with the case using a noncrystalline resin having the same viscosity, the melting requires heating for a longer time or a larger amount of heat, and compared with the case where the binder resin of the toner is composed of only a noncrystalline resin, particularly where the binder resin of a magenta toner lying on the recording material side in a red image is composed of only a noncrystalline resin, the binder resin becomes difficult to melt and is prevented from penetrating into the recording material, as a result, the change in the hue of the image is suppressed.

<Red Toner for Electrostatic Image Development and Toner Set for Electrostatic Image Development>

The red toner for electrostatic development (hereinafter sometimes simply referred to as a "red toner") according to the exemplary embodiment of the present invention contains a binder resin, a coloring agent and a release agent, wherein assuming that the image density when forming an image on a recording material with a toner loaded amount of 4.0 g/m$^2$ is ID and the hue angle of the image expressed by an L*a*b* color coordinate space (provided that a hue angle of 0° is on the a*+ axis and a hue angle of 90° is on the b*+ axis) is A, the following formulae are satisfied:

$$0.3<ID<1.2$$

$$5°<A<35°.$$

In the red toner for electrostatic image development according to this exemplary embodiment, assuming that the image density when forming an image of a magenta toner and a yellow toner, which are used together in an image forming apparatus, on a recording material with a toner loaded amount of 4.0 g/m$^2$ for each toner is IDmy and the hue angle of the image expressed by an L*a*b* color coordinate space is Amy, the following formulae are preferably satisfied:

$$0.2<(ID/IDmy)<0.7$$

$$A<Amy.$$

In the toner according to this exemplary embodiment, assuming that the image density when forming an image on a recording material with a toner loaded amount of 4.0 g/m$^2$ is ID, 0.3<ID<1.2, preferably 0.4<ID<1.0. If ID is 0.3 or less, the density is too low and the change in the hue of a red image cannot be suppressed, whereas if it is 1.2 or more, the change in the hue cannot be suppressed in a red image having a low image density. The image density varies depending on the toner particle diameter, the amount of developing toner, and the like. More specifically, when the toner particle diameter is small, the packing of the toner at the formation of an image is enhanced and therefore, a good image is obtained even with a small amount of developing toner. The term "image density when forming an image on a recording material with a toner loaded amount of 4.0 g/m$^2$" as used in this exemplary embodiment indicates an image density when an image is formed on a recording material such that the concentration of a magenta coloring agent (e.g., magenta pigment) becomes 0.2 g/m$^2$.

In the red toner according to this exemplary embodiment, assuming that when forming an image on a recording material with a toner loaded amount of 4.0 g/m$^2$, the hue angle of the image expressed by an L*a*b* color coordinate space (provided that a hue angle of 0° is on the a*+ axis and a hue angle of 90° is on the b*+ axis) is A, 5°<A<35°, preferably 10°<A<30°. If A is less than 5°, the hue becomes close to that of a magenta toner and the change in the hue of a red image cannot be suppressed, whereas if it exceeds 35°, the hue becomes close that of a yellow toner and the change in the hue of a red image cannot be suppressed.

In the red toner according to this exemplary embodiment, assuming that the image density when forming an image of a magenta toner and a yellow toner, which are used together in an image forming apparatus, on a recording material with a toner loaded amount of 4.0 g/m$^2$ for each toner is IDmy, the toner preferably satisfies 0.2<(ID/IDmy)<0.7, preferably 0.3<(ID/IDmy)<0.6. If (ID/IDmy) is 0.2 or less, the density is too low and the change in the hue of a red image may not be suppressed, whereas if it is 0.7 or more, the change in the hue of a red image with a low image density may not be suppressed.

In the red toner according to this exemplary embodiment, assuming that when forming an image of a magenta toner and a yellow toner, which are used together in an image forming apparatus, on a recording material with a toner loaded amount of 4.0 g/m$^2$ for each toner, the hue angle of the image expressed by an L*a*b* color coordinate space is Amy, the toner preferably satisfies A<Amy. If Amy≦A, the lack of magenta due to penetration may not be compensated for. Also, the toner preferably satisfies 5°<(Amy−A)<35°, more preferably 10°<(Amy−A)<30°. If (Amy−A) is 5° or less, the hue becomes close to that of a magenta toner and the change in the hue of a red image may not be suppressed, whereas if it is 35° or more, the hue becomes close that of a yellow toner and the change in the hue of a red image may not be suppressed.

The hue angle A of the red toner may be adjusted, for example, by the kind of a pigment, a dye or the like used as the coloring agent of the toner or the dispersion diameter of the pigment used. Also, the hue angle A may be adjusted by using a plurality of kinds of pigments or dyes as the coloring agent of the toner.

The image density ID may be adjusted, for example, by the content of the coloring agent in the toner or the dispersion diameter of the pigment used.

The toner set for electrostatic image development (hereinafter sometimes simply referred to as a "toner set") according to this exemplary embodiment of the present invention includes at least a magenta toner containing a binder resin, a coloring agent and a release agent, a yellow toner containing a binder resin, a coloring agent and a release agent, and a red toner containing a binder resin, a coloring agent and a release agent. Assuming that the image density when forming an image of the red toner on a recording material with a toner loaded amount of 4.0 g/m$^2$ is ID and the hue angle of the image expressed by an L*a*b* color coordinate space (provided that a hue angle of 0° is on the a*+ axis and a hue angle of 90° is on the b*+ axis) is A and that the image density when forming an image of the magenta toner and the yellow toner on a recording material with a toner loaded amount of 4.0 g/m$^2$ for each toner is IDmy and the hue angle of the image expressed by an L*a*b* color coordinate space is Amy, the following formulae are satisfied:

$$0.3<ID<1.2$$

$$5°<A<35°$$

$$0.2<(ID/IDmy)<0.7$$

$$A<Amy.$$

The toner set for electrostatic image development according to this exemplary embodiment may further include a cyan toner, a black toner and the like.

(Binder Resin)

Examples of the binder resin of the toner include homopolymers and copolymers of: monoolefins such as ethylene, propylene, butylene and isoprene; vinyl esters such as vinyl acetate, vinyl propionate, vinyl benzoate and vinyl butyrate; α-methylene aliphatic monocarboxylic acid esters such as methyl acrylate, phenyl acrylate, octyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropenyl ketone. In particular, typical examples of the binder resin include a polystyrene, a styrene-alkyl acrylate copolymer, a styrene-butadiene copolymer, a styrene-maleic anhydride copolymer, a polystyrene and a polypropylene. Other examples include a polyester, a polyurethane, an epoxy resin, a silicone resin, a polyamide and a modified rosin. In addition, a noncrystalline polyester resin using, as a constituent component, an alkenylsuccinic acid such as dedecenylsuccinic acid or an anhydride thereof may be also used.

As described above, the binder resin preferably contains a crystalline resin having crystallinity and may contain a crystalline resin and the above-described noncrystalline resin.

In the case where the toner contains a crystalline resin as the binder resin, the content of the crystalline resin in the toner binder resin is, for example, preferably from 2 to 20 wt % or about 2 to about 20 wt %, more preferably from 3 to 15 wt % or about 3 to about 15 wt %. If the content of the crystalline resin is less than 2 wt %, heat absorption by the crystalline resin at the fixing is insufficient and the effect may not be obtained, whereas if it exceeds 20 wt %, the domain of the crystalline resin in the toner becomes large or the number of domains increases and the transparency of the formed image may be worsened. The content of the crystalline resin in the toner binder resin is calculated by the following method.

First, the toner is dissolved in methyl ethyl ketone (MEK) at ordinary temperature (from 20 to 25° C.). This is performed because in the case of containing a crystalline polyester resin and a noncrystalline resin in the toner, almost only the noncrystalline resin dissolves in MEK at ordinary temperature. Accordingly, a noncrystalline resin is contained in the MEK-soluble component and from the supernatant separated by centrifugation after dissolving the toner, a noncrystalline resin is obtained. On the other hand, the solid component after centrifugation is dissolved in THF under heating at 65° C. for 60 minutes and when the resulting solution is filtered through a glass filer at 60° C., a crystalline polyester resin is obtained from the filtered component. As regards this operation, if the temperature drops during filtration, the crystalline resin precipitates. Therefore, the operation is quickly performed to prevent a drop of the temperature and at the same time, in a keep-warm state. The amount of the thus-obtained crystalline polyester resin is measured, whereby the content of the crystalline resin is determined.

The term "crystalline" in the "crystalline resin" as used in this exemplary embodiment indicates that in the differential scanning calorimetry (DSC), the resin exhibits no stepwise endothermic change but has a clear endothermic peak at the temperature rise stage and at the same time, has a clear exothermic peak at the temperature drop stage. More specifically, in the differential scanning calorimetry (DSC) using a differential scanning calorimeter (name of apparatus: Model DSC-60) manufactured by Shimadzu Corporation equipped with an automatic tangent processing system, when the temperature from the on-set point at the time of raising the temperature at a temperature rise rate of 10° C./min to the peak top of the endothermic peak is within 10° C., the endothermic peak is defined as a "clear" endothermic peak. On the other hand, when the temperature between the on-set point at the time of lowering the temperature from 150° C. at a temperature drop rate of −10° C./min and the peak top of the exothermic peak is within 10° C. and the heat value is 20 J/g or more, the exothermic peak is defined as a "clear" exothermic peak. In view of the sharp-melt property, the temperature from the on-set point to the peak top of the endothermic peak is preferably within 10° C., more preferably within 6° C. An arbitrary point in the flat part of the base line in the DSC curve and an arbitrary point in the flat part of the falling area from the base line are designated, and the intersection of tangent lines passing those two points of the flat parts is automatically determined as the "on-set point" by the automatic tangent processing system. When the resin is formed into a toner, the endothermic peak sometimes indicates a peak having a width from 40 to 50° C.

The "noncrystalline resin" used as the binder resin indicates a resin not coming under the above-described crystalline resin. More specifically, in the differential scanning calorimetry (DSC) using a differential scanning calorimeter (name of apparatus: Model DSC-60) manufactured by Shimadzu Corporation equipped with an automatic tangent processing system, when the temperature from the on-set point at the time of raising the temperature at a temperature rise rate of 10° C./min to the peak top of the endothermic peak exceeds 10° C., when a clear endothermic peak is not recognized, or when a clear exothermic peak is not recognized at the temperature drop, the resin is defined as "noncrystalline". The temperature from the on-set point to the peak top of the endothermic peak preferably exceeds 12° C., and it is more preferred that a clear endothermic peak is not recognized. The way of determining the "on-set point" in the DSC curve is the same as in the case of the "crystalline resin" above.

Specific examples of the crystalline resin include a crystalline polyester resin and a crystalline vinyl-based resin, and of these, in view of adhesion to paper or chargeability at the fixing and adjustment of the melting temperature in the preferred range, a crystalline polyester resin is preferred. An aliphatic crystalline polyester resin having an appropriate melting temperature is more preferred.

Examples of the crystalline vinyl-based resin include a vinyl-based resin using a (meth)acrylate ester of a long-chain alkyl or alkenyl, such as amyl (meth)acrylate, hexyl (meth) acrylate, heptyl (meth)acrylate, octyl (meth)acrylate, nonyl (meth)acrylate, decyl (meth)acrylate, undecyl (meth)acrylate, tridecyl (meth)acrylate, myristyl (meth)acrylate, cetyl (meth)acrylate, stearyl (meth)acrylate, oleyl (meth)acrylate and behenyl (meth)acrylate. Incidentally, the term "(meth) acryl" as used in the context of the present invention means to include both an "acryl" and a "methacryl".

(Crystalline Polyester Resin)

The crystalline polyester resin liquid dispersion is obtained by dispersing a crystalline polyester resin in an aqueous medium. The crystalline polyester resin used in the crystalline polyester resin liquid dispersion is described below.

The crystalline polyester resin is synthesized from a divalent acid (dicarboxylic acid) component and a dihydric alcohol (diol) component, and the term "crystalline polyester resin" indicates a resin having a clear endothermic peak in the differential scanning calorimetry (DSC) and not exhibiting a stepwise endothermic change. In the case of a polymer where another component is polymerized to the main chain of the crystalline polyester resin, when the content of another component is 50 mass % or less, this copolymer is also called a crystalline polyester resin.

In the crystalline polyester resin, the acid working out to an acid-derived constituent component includes various dicarboxylic acids. The dicarboxylic acid as the acid-derived constituent component is not limited to one kind of a dicarboxylic acid, but the resin may contain two or more kinds of dicarboxylic acid-derived constituent components. The dicarboxylic acid preferably contains a sulfonic group so as to improve the emulsifiability in an emulsion aggregation method.

Incidentally, the term "acid-derived constituent component" above indicates a constituent site that is an acid component before the synthesis of the polyester resin, and the term "alcohol-derived component" described below indicates a constituent site that is an alcohol component before the synthesis of the polyester resin.

The dicarboxylic acid is preferably an aliphatic dicarboxylic acid, more preferably a linear dicarboxylic acid. Examples of the linear dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,18-octadecanedicarboxylic acid, 1,20-eicosanedicarboxylic acid, and lower alkyl esters or acid anhydrides thereof. Among these, a dicarboxylic acid having a carbon number of 6 to 20 is preferred. For raising the crystallinity, such a linear dicarboxylic acid is preferably used in a ratio of 95 mol % or more, more preferably 98 mol % or more, based on the acid constituent component.

As for the acid-derived constituent component, other than the above-described aliphatic dicarboxylic acid-derived constituent component, a constituent component such as dicarboxylic acid-derived constituent component having a sulfonic group may be contained. Also, when a sulfonic acid group is present at the time of emulsifying or suspending the entire resin in water to produce a toner particle, as described later, emulsification or suspension can be performed without using a surfactant.

Examples of the dicarboxylic acid having a sulfonic group include, but are not limited to, sodium 2-sulfoterephthalate, sodium 5-sulfoisophthalate, sodium sulfosuccinate, and lower alkyl esters or acid anhydrides thereof. Among these, in view of productivity, sodium 5-sulfoisophthalate is preferred. The content of the dicarboxylic acid having a sulfonic acid group is preferably 2.0% or less by constitutional mol, more preferably 1.0% or less by constitutional mol. Here, the expression "% by constitutional mol" indicates a percentage when various constituent components (e.g., acid-derived constituent component, alcohol-derived constituent component) in the polyester resin each is assumed to be 1 unit (mol).

In the crystalline polyester resin, the alcohol working out to the alcohol-derived constituent component is preferably an aliphatic dialcohol, and examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol and 1,20-eicosanediol. Among these, a dialcohol having a carbon number of 6 to 20 is preferred. For raising the crystallinity, such a linear dialcohol is preferably used in an amount of 95 mol % or more, more preferably 98 mol % or more, based on the alcohol constituent component.

Other examples of the dihydric dialcohol include bisphenol A, hydrogenated bisphenol A, an ethylene oxide or(and) propylene oxide adduct of bisphenol A, 1,4-cyclohexanediol, 1,4-cyclohexanedimethanol, diethylene glycol, propylene glycol, dipropylene glycol, 1,3-butanediol and neopentyl glycol. One of these dialcohols may be used alone, or two or more thereof may be used in combination.

For the purpose of, for example, adjusting the acid value or hydroxyl value, a monovalent acid such as acetic acid and benzoic acid, a monohydric alcohol such as cyclohexanol and benzyl alcohol, a benzenetricarboxylic acid, a naphthalenetricarboxylic acid, acid anhydrides or lower alkyl esters thereof, or a trihydric alcohol such as glycerin, trimethylolethane, trimethylolpropane and pentaerythritol, may be used, if desired.

Other monomers are not particularly limited, and examples thereof include conventionally known divalent carboxylic acids and dihydric alcohols which are monomer components described in Kobunshi Data Handbook: Kiso Hen (Polymer Data Handbook: Basic Edition), compiled by The Society of Polymer Science, Japan, Baifukan. As for specific examples of these monomer components, examples of the divalent carboxylic acid include a dibasic acid such as phthalic acid, isophthalic acid, terephthalic acid, naphthalene-2,6-dicarboxylic acid, naphthalene-2,7-dicarboxylic acid and cyclohexanedicarboxylic acid, and anhydrides or lower alkyl esters thereof. One of these monomer components may be used alone, or two or more thereof may be used in combination.

The crystalline polyester resin may be synthesized from an arbitrary combination of the monomer components above, for example, by a conventionally known method described in Jushukugo (Polycondensation), Kagaku Dojin, Kobunshi Jikkenngaku; Jushukugo to Jufuka (Experimental Study of Polymer; Polycondensation and Polyaddition), Kyoritsu Shuppan, and Polyester Jushi Handbook (Polyester Resin Handbook), compiled by Nikkan Kogyo Shibun Sha. A transesterification method, a direct polycondensation method and the like may be used individually or in combination.

More specifically, the synthesis may be performed at a polymerization temperature of 140 to 270° C., and, if desired, the reaction may be performed while removing water or alcohol generated at the condensation by reducing the pressure in the reaction system. In the case where the monomer does not dissolve or compatibilize at the reaction temperature, the monomer may be dissolved by adding a solvent having a high boiling temperature as a dissolution assisting solvent. The polycondensation reaction may be performed while distilling off the dissolution assisting solvent. In the case where a poorly compatible monomer is present at the copolymerization reaction, after previously condensing the poorly compatible monomer with an acid or alcohol that is intended to be polycondensed with the monomer, the condensation product may be polycondensed together with the main component. The molar ratio (acid component/alcohol component) when reacting the acid component and the alcohol component varies depending on the reaction conditions and the like and cannot be indiscriminately specified, but in the case of direct polycondensation, the molar ratio is usually from 0.9/1.0 to 1.0/0.9. In the case of a transesterification reaction, a monomer that is removable by distillation under vacuum, such as ethylene glycol, propylene glycol, neopentyl glycol, and cyclohexanedimethanol, is sometimes used in excess.

The catalyst that can be used in the production of the crystalline polyester resin is a titanium-containing catalyst, and examples thereof include aliphatic titanium carboxylates such as aliphatic titanium monocarboxylate (e.g., titanium acetate, titanium propionate, titanium hexanoate, titanium octanoate), aliphatic titanium dicarboxylate (e.g., titanium oxalate, titanium succinate, titanium maleate, titanium adipate, titanium sebacate), aliphatic titanium tricarboxylate (e.g., titanium hexanetricarboxylate, titanium isooctanetricarboxylate), and aliphatic titanium polycarboxylate (e.g., titanium octanetetracarboxylate, titanium decanetetracarboxylate); aromatic titanium carboxylates such as aromatic titanium monocarboxylate (e.g., titanium benzoate), aromatic titanium dicarboxylate (e.g., titanium phthalate, titanium terephthalate, titanium isophthalate, titanium naphthalenedicarboxylate, titanium biphenyldicarboxylate, titanium anthracenedicarboxylate), aromatic titanium tricarboxylate (e.g., titanium trimellitate, titanium naphthalenetricarboxylate), and aromatic titanium tetracarboxylate (e.g., titanium benzenetetracarboxylate, titanium naphthalenetetracarboxylate); titanyl compounds of aliphatic titanium carboxylates or aromatic titanium carboxylates, and alkali metal salts thereof; halogenated titanium compounds such as dichlorotitanium, trichlorotitanium, tetrachlorotitanium and tetrabromotitanium; tetraalkoxy titanium compounds such as tetrabutoxy titanium (titanium tetrabutoxide), tetraoctoxy titanium and tetrastearyloxy titanium; titanium acetylacetonate; titanium diisopropoxide bisacetylacetonate; and titanium triethanol aminate.

As for the catalyst, using the titanium-containing catalyst above or an inorganic tin-based catalyst as the main catalyst, other catalysts may be mixed. As for other catalysts, those described above for the noncrystalline polyester resin may be used.

At the polymerization, the catalyst is preferably added in a range from 0.02 to 1.0 parts by mass per 100 parts by mass of the monomer component. However, in the case of using the catalyst by mixing those catalysts, the content of the titanium-containing catalyst is preferably 70 mass % or more, and it is more preferred that the catalysts all are the titanium-containing catalyst.

The melting temperature of the crystalline polyester resin is preferably from 50 to 120° C. or about 50 to about 120° C., more preferably from 60 to 110° C. or about 60 to about 110° C.

The differential thermal analysis for determining the melting temperature is performed by differential scanning calorimetry in accordance with ASTM D3418-8, and this measurement is performed as follows. That is, a toner to be measured is set on a differential scanning calorimeter (DSC-50) manufactured by Shimadzu Corporation equipped with an automatic tangent processing system and after setting liquid nitrogen as a cooling medium, the toner is heated to 150° C. from 20° C. at a temperature rise rate of 10° C./min (first temperature rising process) to determine the relationship between temperature (° C.) and heat quantity (mW). Subsequently, the toner is cooled to 0° C. at a temperature drop rate of −10° C./min and then again heated to 150° C. at a temperature rise rate of 10° C./min (second temperature rising process), and the data are collected. Here, the toner is held at 0° C. and 150° C. each for 5 minutes. An endothermic peak temperature in the second temperature rising process is regarded as the melting temperature. Incidentally, the crystalline resin sometimes shows a plurality of melting peaks, but of these, the maximum peak is regarded as the melting temperature.

As for the molecular weight of the crystalline polyester resin, in the molecular weight measurement by the GPC method of the tetrahydrofuran (THF)-soluble component, the weight average molecular weight (Mw) is preferably from 5,000 to 100,000 or about 5,000 to about 100,000, more preferably from 10,000 to 50,000 or about 10,000 to about 50,000, and the number average molecular weight (Mn) is preferably from 2,000 to 30,000 or about 2,000 to about 30,000, more preferably from 5,000 to 15,000 or about 5,000 to about 15,000. The molecular weight distribution Mw/Mn is preferably from 1.5 to 20, more preferably from 2 to 5. At the measurement of the molecular weight, the crystalline resin is preferably heated and dissolved over a hot water bath at 70° C., because its solubility in THF is poor.

The acid value of the crystalline polyester resin is preferably from 4 to 20 mgKOH/g, more preferably from 6 to 15 mgKOH/g, and the hydroxyl value is preferably from 3 to 30 mgKOH/g, more preferably from 5 to 15 mgKOH/g.

(Coloring Agent)

As for the coloring agent used in the red toner according to this exemplary embodiment, one kind of a red coloring agent may be used alone, or two or more kinds of coloring agents such as red coloring agent, yellow coloring agent and magenta coloring agent may be used as a mixture. A pigment may be used as the coloring agent. Also, a dye may be used, if desired. Mixing of two or more kinds of pigments sometimes causes turbidity, and it is preferred to use one kind of a red pigment alone.

Examples of the red pigment include iron oxide red, cadmium red, red lead, mercury sulfide, Watchung Red, Permanent Red 4R, Lithol Red, Brilliant Carmine 3B, Brilliant Carmine 6B, DuPont Oil Red, Pyrazolone Red, Rhodamine B Lake, Lake Red C, Rose Bengal, Eoxine Red and Alizarin Lake.

Examples of the magenta pigment include red iron oxide, cadmium red, red lead, cadmium mercury sulfide, Watchung Red, Permanent Red 4R, Lithol Red, Brilliant Carmine 3B, Brilliant Carmine 6B, DuPont Oil Red, Pyrazolone Red, Rhodamine Lake B, Lake Red C, Rose Bengal, Eoxine Red, Alizarin Lake, a naphthol-based pigment such as C.I. Pigment Red 31, C.I. Pigment Red 146, C.I. Pigment Red 147, C.I. Pigment Red 150, C.I. Pigment Red 176, C.I. Pigment Red 238 and C.I. Pigment Red 269, and a quinacridone-based pigment such as C.I. Pigment Red 122, C.I. Pigment Red 202 and C.I. Pigment Red 209. Among these, C.I. Pigment Red 185, C.I. Pigment Red 238, C.I. Pigment Red 269 and C.I. Pigment Red 122 are preferred.

Examples of the yellow pigment include chrome yellow, zinc yellow, yellow iron oxide, cadmium yellow, chromium yellow, Hansa Yellow, Hansa Yellow 10G, Benzidine Yellow G, Benzidine Yellow GR, Threne Yellow, Quinoline Yellow and Permanent Yellow NCG. Specific examples thereof include C.I. Pigment Yellow 74, C.I. Pigment Yellow 180, C.I. Pigment Yellow 93, C.I. Pigment Yellow 185, and C.I. Pigment Yellow 155, C.I. Pigment Yellow 128, C.I. Pigment Yellow 111 and C.I. Pigment Yellow 17. In view of pigment dispersibility, C.I. Pigment Yellow 74 and C.I. Pigment Yellow 185 are preferred.

Other than these red coloring agent, yellow coloring agent and magenta coloring agent, examples of the coloring agent for use in the toner set according to this exemplary embodiment include the followings.

Examples of the black pigment include carbon black, copper oxide, manganese dioxide, aniline black, activated carbon, nonmagnetic ferrite and magnetite.

Examples of the orange pigment include red chrome yellow, molybdenum orange, Permanent Orange GTR, Pyrazolone Orange, Vulcan Orange, Benzidine Orange G, Indanthrene Brilliant Orange RK and Indanthrene Brilliant Orange GK.

Examples of the blue pigment include Prussian Blue, cobalt blue, Alkali Blue Lake, Victoria Blue Lake, Fast Sky Blue, Indanthrene Blue BC, Aniline Blue, Ultramarine Blue, Calco Oil Blue, Methylene Blue Chloride, Phthalocyanine Blue, Phthalocyanine Green and Malachite Green Oxalate.

Examples of the green pigment include chromium oxide, chrome green, Pigment Green 7, Pigment Green 36, Malachite Green Lake and Final Yellow Green G. As for the green pigment, Pigment Green 7 and Pigment Green 36 are preferred.

Examples of the purple pigment include Manganese Purple, Fast Violet B and Methyl Violet Lake.

Examples of the white pigment include zinc white, titanium oxide, antimony white and zinc sulfide.

Examples of the extender pigment include barytes, barium carbonate, clay, silica, white carbon, talc and alumina white.

Also, a dye may be used as the coloring agent, if desired. The dye includes various dyes such as basic, acidic, disperse and direct dyes, and examples thereof include nigrosine, Methylene Blue, Rose Bengal, Quinoline Yellow and ultramarine blue. One of these coloring agents may be used alone or a mixture thereof may be used. Furthermore, the coloring agent may also be used in the state of a solid solution.

The content of the coloring agent in the red toner according to this exemplary embodiment is, for example, preferably from 0.5 to 8 wt % or about 0.5 to about 8 wt %, more preferably from 1 to 4 wt % or about 1 to about 4 wt %, based on the entire weight of the toner. If the content is less than 0.5 wt %, the density is too low and the effect of correcting the magenta color may not be obtained, whereas if it exceeds 8 wt %, the density is excessively high and the effect in a low density image may not be obtained.

The content of the coloring agent in the toner except for the red toner of the toner set according to this exemplary embodiment is, for example, preferably from 1 to 15 wt %, more preferably from 3 to 12 wt %, based on the entire weight of the toner.

The dispersion diameter of the pigment in the red toner according to this exemplary embodiment is, for example, preferably from 30 to 500 nm or about 30 to about 500 nm, more preferably from 50 to 300 nm or about 50 to about 300 nm. If the dispersion diameter is less than 30 nm, flocculation may occur, whereas if it exceeds 500 nm, exposure of the pigment to the toner surface may be caused.

(Release Agent)

The toner according to this exemplary embodiment preferably contains a release agent. The release agent used is preferably a substance having a main maximum endothermic peak at 60 to 120° C. or about 60 to about 120° C. in DSC measured in accordance with ASTM D3418-8 and a melting viscosity of 1 to 50 mPas at 140° C.

The endothermic initiation temperature of the release agent in the DSC curve measured by the differential scanning calorimeter is preferably 40° C. or more, more preferably 50° C. or more. The endothermic initiation temperature varies depending on the low molecular weight component in the molecular weight distribution constituting the wax or the kind or amount of the polar group contained in the structure of such a component. In general, when the molecular weight is increased, the endothermic initiation temperature is raised together with the melting temperature, but in this case, the low melting temperature and low viscosity inherent in the wax are sometimes impaired. Therefore, it is effective to selectively remove the low molecular weight component out of the molecular weight distribution of the wax, and examples of the method therefor include a method such as molecular distillation, solvent fractionation and gas chromatographic separation. The measurement of DSC is as described above.

The melting viscosity of the release agent is measured by an E-type viscometer. At the measurement, an E-type viscometer (manufactured by Tokyo Keiki Co., Ltd.) equipped with an oil circulating constant temperature bath is used. The measurement is performed using a plate by a cone and plate/cup combination with a cone angle of 1.34°. The sample is charged into the cup, the temperature of a circulating device is set to 140° C., an empty measuring cup and a cone are set in the measuring apparatus, the temperature is kept constant by circulating an oil, and when the temperature is stabilized, 1 g of the sample is put in the measuring cup and left standing still for 10 minutes in a state of the cone being stationary. After stabilization, the cone is rotated and the measurement is performed. The rotation speed of the cone is set to 60 rpm. The measurement is performed three times, and the average value thereof is used as the melting viscosity $\eta$.

Specific examples of the release agent include low molecular weight polyolefins such as polyethylene, polypropylene and polybutene; silicones showing a softening temperature under heating; fatty acid amides such as oleic acid amide, erucic acid amide, ricinoleic acid amide and stearic acid amide; vegetable waxes such as carnauba wax, rice wax, candelilla wax, Japan wax and jojoba oil; animal waxes such as bees wax; ester waxes such as fatty acid ester and montanic acid ester; mineral or petroleum waxes such as montan wax, ozokerite, ceresin, paraffin wax, microcrystalline wax and Fischer-Tropsch wax; and modified products thereof.

The amount of the release agent added is preferably from 1 to 15 parts by mass or about 1 to about 15 parts by mass, more preferably from 3 to 10 parts by mass or about 3 to about 10 parts by mass, per 100 parts by mass of the binder resin. If the amount added of the release agent is less than 1 part by mass, the effect of the release agent may not be brought out, whereas if it exceeds 15 parts by mass, poor flowability and a very wide electric charge distribution may result.

(Other Components)

In the toner according to this exemplary embodiment, an inorganic or organic particle may be added, if desired. As for the inorganic particle, silica, hydrophobed silica, alumina, titanium oxide, calcium carbonate, magnesium carbonate, tricalcium phosphate, colloidal silica, alumina-treated colloidal silica, cation surface-treated colloidal silica, anion surface-treated colloidal silica and the like may be used individually or in combination. Above all, colloidal silica is preferably used. The volume average particle diameter thereof is preferably from 5 to 50 nm. Also, a particle differing in the particle diameter may be used in combination. The particle may be directly added at the production of the toner but is preferably used by previously dispersing it in a water-soluble medium such as water by means of an ultrasonic disperser or the like. At the time of dispersing the particle, an ionic surfactant or a polymer acid or polymer base may be used to enhance the dispersibility.

In addition, a known material such as charge controlling agent may be added to the toner. The volume average particle diameter of the material added is preferably 1 μM or less, more preferably from 0.01 to 1 μm. The volume average particle diameter is measured, for example, by using Microtrac.

<Production Method of Electrostatic Image Developing Toner>

The production method of the electrostatic image developing toner of this exemplary embodiment may utilize, for example, a generally employed kneading pulverization method or wet granulation method. Examples of the wet granulation method include a suspension polymerization method, an emulsion polymerization method, an emulsion polymerization aggregation method, a soap-free emulsion polymerization method, a non-aqueous dispersion polymerization method, an in-situ polymerization method, an interfacial polymerization method, an emulsion dispersion granulation method and an aggregation/coalescence method. Among these, for example, from the standpoint of encapsulating a crystalline resin in the toner, a wet granulation method is preferred.

Preferred examples of the wet granulation method include a known method such as melting suspension method, emulsion aggregation method and dissolution suspension method. The production method is described below by referring to the emulsion aggregation method as an example.

The emulsion aggregation method is a production method including a step of forming an aggregated particle in a liquid dispersion having dispersed therein at least a resin particle (hereinafter sometimes referred to as an "emulsified liquid") to prepare an aggregated particle liquid dispersion (aggregating step), and a step of heating the aggregated particle liquid dispersion to fuse aggregated particles (fusing step). Furthermore, a step of dispersing an aggregated particle (dispersing step) may be provided before the aggregating step, or a step of adding and mixing a particle liquid dispersion having dispersed therein a particle, in the aggregated particle liquid dispersion to adhere a particle to the aggregated particle and form an adhered particle (adhering step) may be provided between the aggregating step and the fusing step. In the adhering step, the particle liquid dispersion is added and mixed in the aggregated particle liquid dispersion prepared in the aggregating step to adhere the particle to the aggregated particle and form an adhered particle, but in relation to the aggregated particle, the particle added comes under a particle newly added to the aggregated particle and therefore, is sometimes referred to as an "addition particle".

Other than the resin particle, examples of the addition particle include a release agent particle and a coloring agent particle, and one of these particles may be used alone or a plurality thereof may be used in combination. The method for adding and mixing the particle liquid dispersion is not particularly limited, and the dispersion may be added gradually and continuously or may be added stepwise in parts a plurality of times. By providing the above-described adhering step, a pseudo shell structure is formed.

In the toner according to this exemplary embodiment, a core-shell structure is preferably formed by an operation of adding the above-described addition particle. The binder resin working out to the main component of the addition particle is a resin for shell layer. Use of this method facilitates controlling the shape of the toner particle by adjusting the temperature, stirring number, pH or the like in the fusing step.

In the above-described emulsion aggregation method, a liquid dispersion of the crystalline polyester resin is used, and a noncrystalline polyester resin liquid dispersion is preferably used in combination. It is more preferred to include an emulsifying step of emulsifying the noncrystalline polyester resin to form an emulsified particle (liquid droplet).

In the emulsifying step, the emulsified particle (liquid droplet) of the noncrystalline polyester resin is formed by applying a shear force to a solution that is a mixture containing an aqueous medium, a noncrystalline polyester resin and, if desired, a coloring agent-containing mixed solution (polymer solution). At this time, the emulsified particle may also be formed by decreasing the viscosity of the polymer liquid under heating to a temperature not lower than the glass transition temperature of the noncrystalline polyester resin. A dispersant may also be used. Hereinafter, the liquid dispersion of such an emulsified particle is sometimes referred to as a "noncrystalline polyester resin liquid dispersion".

Examples of the emulsifier used at the formation of the emulsified particle include a homogenizer, a homomixer, a pressure kneader, an extruder and a media disperser. The size of the emulsified particle (liquid droplet) of the polyester resin is, in terms of the average particle diameter (volume average particle diameter), preferably from 0.005 to 0.5 μm, more preferably from 0.01 to 0.3 μm.

In this respect, the volume average particle diameter of the resin particle is measured by a Doppler scattering particle size distribution analyzer (Microtrac UPA9340, manufactured by Nikkiso Co., Ltd.).

If the melting viscosity of the resin at the emulsification is high, the particle diameter is not reduced to a desired value. Accordingly, emulsification may be performed in a state of the temperature being raised and the resin viscosity being decreased by using an emulsifier capable of applying a pressure to an atmospheric pressure or more so as to obtain a noncrystalline polyester resin liquid dispersion having a desired particle diameter.

In the emulsifying step, for the purpose of decreasing the resin viscosity, a method of previously adding a solvent to the resin may also be used. The solvent used is not particularly limited as long as it can dissolve the polyester resin, and, for example, a ketone-based solvent such as tetrahydrofuran (THF), methyl acetate, ethyl acetate and methyl ethyl ketone, or a benzene-based solvent such as benzene, toluene and xylene, may be used. It is preferred to use an ester- or ketone-based solvent such as ethyl acetate or methyl ethyl ketone.

An alcohol-based solvent such as ethanol or isopropyl alcohol may be directly added to water or the resin. A salt such as sodium chloride and potassium chloride, or ammonia may also be added. Of these, ammonia is preferably used.

Furthermore, a dispersant may be added. Examples of the dispersant include a water-soluble polymer such as polyvinyl alcohol, methyl cellulose, carboxymethyl cellulose and sodium polyacrylate; a surfactant such as anionic surfactant (e.g., sodium dodecylbenzenesulfonate, sodium octadecylsulfate, sodium oleate, sodium laurate, potassium stearate), cationic surfactant (e.g., laurylamine acetate, lauryltrimethylammonium chloride), amphoteric ionic surfactant (e.g., lauryldimethylamine oxide) and nonionic surfactant (e.g., polyoxyethylene alkyl ether, polyoxyethylene alkylphenyl ether, polyoxyethylene alkylamine); and an inorganic compound such as tricalcium phosphate, aluminum hydroxide, calcium sulfate, calcium carbonate and barium carbonate. Among these, an anionic surfactant is preferred. The amount used of the dispersant is preferably from 0.01 to 20 parts by mass per 100 parts by mass of the polyester resin (binder resin). However, the dispersant affects the chargeability in many cases and therefore, when emulsifiability can be ensured by, for example, the hydrophilicity of the main chain of the polyester resin or the amount of the acid value and hydroxyl group value at the terminal, the dispersant is preferably added as little as possible.

In the emulsifying step, a dicarboxylic acid having a sulfonic acid group may be copolymerized in the noncrystalline polyester resin (that is, an appropriate amount of a constituent component derived from a dicarboxylic acid having a sulfonic acid group is contained in an acid-derived constituent component). The amount added thereof is preferably 10 mol % or less in the acid component, but when emulsifiability can be ensured by, for example, the hydrophilicity of the main chain of the polyester resin or the amount of the acid value and hydroxyl group value at the terminal, the sulfonic acid group-containing dicarboxylic acid is preferably added as little as possible.

A phase inversion emulsification method may also be used in forming the emulsified particle. The phase inversion emulsification method is a method of dissolving at least the noncrystalline polyester resin in a solvent, adding, if desired, a neutralizer or a dispersion stabilizer, adding dropwise an aqueous medium under stirring, and after obtaining an emulsified particle, removing the solvent in the resin liquid dispersion to obtain an emulsified liquid. At this time, the order in which a neutralizer and a dispersion stabilizer are charged may be changed.

Examples of the solvent in which the resin is dissolved include formic acid esters, acetic acid esters, butyric acid esters, ketones, ethers, benzenes and halogenated carbons. Specific examples thereof include esters of formic acid, acetic acid or butyric acid, such as methyl, ethyl, n-propyl, isopropyl, n-butyl, isobutyl, sec-butyl and tert-butyl esters; methyl ketones such as acetone, methyl ethyl ketone (MEK), methyl propyl ketone (MPK), methyl isopropyl ketone (MIPK), methyl butyl ketone (MBK) and methyl isobutyl ketone (MIBK); ethers such as diethyl ether and diisopropyl ether; heterocyclic ring substitution products such as toluene, xylene and benzene; and halogenated carbons such as carbon tetrachloride, methylene chloride, 1,2-dichloroethane, 1,1,2-trichloroethane, trichloroethylene, chloroform, monochlorobenzene and dichloroethylidene. One of these solvents may be used alone, or two or more thereof may be used in combination. Above all, acetic acid esters, methyl ketones and ethers, which are a low boiling temperature solvent, are usually preferred, and acetone, methyl ethyl ketone, acetic acid, ethyl acetate and butyl acetate are more preferred. The solvent used is preferably a solvent having a relatively high volatility so as not to remain in the resin particle. The amount of the solvent used is preferably from 20 to 200 mass %, more preferably from 30 to 100 mass %, based on the amount of the resin.

The aqueous medium is fundamentally sufficient if ion-exchanged water is used, but a water-soluble solvent may be contained to the extent that it does not collapse an oil droplet. Examples of the water-soluble solvent include short carbon chain alcohols such as methanol, ethanol, 1-propanol, 2-propanol, 1-butanol, 2-butanol, tert-butanol and 1-pentanol; ethylene glycol monoalkyl ethers such as ethylene glycol monomethyl ether, ethylene glycol monoethyl ether and ethylene glycol monobutyl ether; ethers; diols; tetrahydrofuran (THF); and acetone. Of these, ethanol and 2-propanol are preferred. The amount of the water-soluble solvent used is preferably from 1 to 60 mass %, more preferably from 5 to 40 mass %, based on the amount of the resin. The water-soluble solvent may be used not only by mixing it with ion-exchanged water to which the resin is added, but also by adding it to a solution in which the resin is dissolved.

Also, if desired, a dispersant may also be added to the noncrystalline polyester resin solution and the aqueous component. Examples of this dispersant include a dispersion stabilizer that forms a hydrophilic colloid in the aqueous component, such as cellulose derivatives (e.g., hydroxymethyl cellulose, hydroxyethyl cellulose, hydroxypropyl cellulose), synthetic polymers (e.g., polyvinyl alcohol, polyvinylpyrrolidone, polyacrylamide, polyacrylate salt, polymethacrylate), gelatin, gum arabic and agar. A solid powder such as silica, titanium oxide, alumina, tricalcium phosphate, calcium carbonate, calcium sulfate and barium carbonate may also be used. The dispersion stabilizer is usually added such that the concentration in the aqueous component becomes preferably from 0 to 20 mass %, more preferably from 0 to 10 mass %.

Also, the dispersant used above may be a surfactant. As for the surfactant, those used for a coloring agent liquid dispersion described later may be used. Examples thereof include a natural surfactant component such as saponin, a cationic surfactant such as alkylamine hydrochloride/acetate salts, quaternary ammonium salts and glycerins, and an anionic surfactant such as fatty acid soaps, sulfuric acid esters, alkylnaphthalene sulfonates, sulfonates, phosphoric acid, phosphoric acid ester and sulfosuccinates, with an anionic surfactant and a nonionic surfactant being preferred. In order to adjust the pH of the emulsified liquid, a neutralizer may also be added. Examples of the neutralizer include an acid and an alkali in general, such as nitric acid, hydrochloric acid, sodium hydroxide and ammonia.

As regards the method for removing the solvent from the emulsified liquid, a method of heating the emulsified liquid at a temperature of 15 to 70° C. to volatilize the solvent, or a method combining reduced pressure to the heating above is preferably used. In this exemplary embodiment, from the standpoint of control or the like of the particle size distribution or particle diameter, a method where after emulsification by a phase inversion emulsification method, the solvent is removed by heating under reduced pressure, is preferably used. In the case of using the emulsified particle for the toner, in view of the effect on chargeability, the emulsifiability is preferably controlled by, for example, the hydrophilicity of the main chain of the polyester resin or the amount of the acid value and hydroxyl group value at the terminal, without using a dispersant or a surfactant as much as possible.

The method for dispersing the coloring agent or release agent is not limited and, for example, a dispersing method in general, such as high-pressure homogenizer, rotary shearing-type homogenizer, ultrasonic disperser, high-pressure counter collision disperser and media-containing mill (e.g., ball mill, sand mill, Dyno mill), may be used.

If desired, a water dispersion of the coloring agent may be prepared using a surfactant, or an organic solvent dispersion of the coloring agent may be prepared using a dispersant. Hereinafter, the liquid dispersion of the coloring agent or release agent is sometimes referred to as a "coloring agent liquid dispersion" or a "release agent liquid dispersion".

The dispersant used in the coloring agent liquid dispersion or release agent liquid dispersion is generally a surfactant. Preferred examples of the surfactant include an anionic surfactant such as sulfuric ester salt type, sulfonate type, phosphoric acid ester type and soap type; a cationic surfactant such as amine salt type and quaternary ammonium salt type; and a nonionic surfactant such as polyethylene glycol type, alkyl phenol ethylene oxide adduct type and polyhydric alcohol type. Among these, an ionic surfactant is preferred, and an anionic surfactant and a cationic surfactant are more preferred. The nonionic surfactant is preferably used in combination with the anionic surfactant or cationic surfactant. One of these surfactants may be used alone, or two or more thereof may be used in combination. The surfactant preferably has the same polarity as the dispersant used in other liquid dispersions such as release agent liquid dispersion.

Specific examples of the anionic surfactant include fatty acid soaps such as potassium laurate, sodium oleate and sodium castor oil; sulfuric acid esters such as octyl sulfate, lauryl sulfate, lauryl ether sulfate and nonyl phenyl ether sulfate; sulfonates such as lauryl sulfonate, dodecyl sulfonate, dodecylbenzene sulfonate, sodium alkylnaphthalenesulfonate (e.g., triisopropylnaphthalene sulfonate, dibutylnaphthalene sulfonate), naphthalene sulfonate formalin condensate, monooctyl sulfosuccinate, dioctyl sulfosuccinate, lauric acid amide sulfonate and oleic acid amide sulfonate; phosphoric acid esters such as lauryl phosphate, isopropyl phosphate and nonyl phenyl ether phosphate; sulfosuccinates such as sodium dialkylsulfosuccinate (e.g., sodium dioctylsulfosuccinate), disodium lauryl sulfosuccinate and disodium lauryl polyoxyethylenesulfosuccinate. Of these, an alkylbenzene sulfonate-based compound such as dodecylbenzene sulfonate and its branched form is preferred.

Specific examples of the cationic surfactant include amine salts such as laurylamine hydrochloride, stearylamine hydrochloride, oleylamine acetate, stearylamine acetate and stearylaminopropylamine acetate; and quaternary ammonium salts such as lauryltrimethylammonium chloride, dilauryldimethylammonium chloride, distearylammonium chloride, distearyldimethylammonium chloride, lauryldihydroxyethylmethylammonium chloride, oleylbispolyoxyethylenemethylammonium chloride, lauroylaminopropyldimethylethylammonium etosulfate, lauroylaminopropyldimethylhydroxyethylammonium perchlorate, alkylbenzenedimethylammonium chloride and alkyltrimethylammonium chloride.

Specific examples of the nonionic surfactant include alkyl ethers such as polyoxyethylene octyl ether, polyoxyethylene lauryl ether, polyoxyethylene stearyl ether and polyoxyethylene oleyl ether; alkyl phenyl ethers such as polyoxyethylene octyl phenyl ether and polyoxyethylene nonyl phenyl ether; alkyl esters such as polyoxyethylene laurate, polyoxyethylene stearate and polyoxyethylene oleate; alkylamines such as polyoxyethylene laurylamino ether, polyoxyethylene stearylamino ether, polyoxyethylene oleylamino ether, polyoxyethylene soybean amino ether and polyoxyethylene tallow amino ether; alkylamides such as polyoxyethylene lauric acid amide, polyoxyethylene stearic acid amide and polyoxyethylene oleic acid amide; vegetable oil ethers such as polyoxyethylene castor oil ether and polyoxyethylene rapeseed oil ether; alkanolamides such as lauric acid diethanolamide, stearic acid diethanolamide, and oleic acid diethanolamide; and sorbitan ester ethers such as polyoxyethylene sorbitan monolaurate, polyoxyethylene sorbitan monopalmitate, polyoxyethylene sorbitan monostearate and polyoxyethylene sorbitan monooleate.

The amount added of the dispersant used is preferably from 2 to 30 mass %, more preferably from 5 to 20 mass %, based on the coloring agent or release agent.

The aqueous dispersion medium used is preferably a medium containing little impurities (e.g., metal ion), such as distilled water or ion-exchanged water. Also, an alcohol or the like may be added. In addition, for example, a polyvinyl alcohol or a cellulose-based polymer may be added, which is, however, preferably used as little as possible so as not to remain in the toner.

The device for producing a liquid dispersion of various additives described above is not particularly limited, but examples thereof include a dispersing apparatus that is itself known, such as rotary shearing-type homogenizer, media-containing mill (e.g., ball mill, sand mill, Dyno mill) and apparatus in accordance with that used for producing the coloring agent liquid dispersion or the release agent liquid dispersion, and an optimal device may be selected and used.

In the aggregating step, it is also preferred to use an aggregating agent for forming an aggregated particle. The aggregating agent used here includes a surfactant having a polarity reverse to that of the surfactant used for the dispersant, and an inorganic metal compound (inorganic metal salt) in general or a polymer thereof. The metal element constituting the inorganic metal salt is a metal element having a divalent or higher electric charge belonging to Groups 2A, 3A, 4A, 5A, 6A, 7A, 8, 1B, 2B and 3B of the Periodic Table (long period), and the metal element is sufficient if it dissolves in the form of an ion in the aggregated system of resin particles.

Specific examples of the inorganic metal salt include a metal salt such as calcium chloride, calcium nitrate, barium chloride, magnesium chloride, zinc chloride, aluminum chloride and aluminum sulfate, and an inorganic metal salt polymer such as polyaluminum chloride, polyaluminum hydroxide and calcium polysulfide. Among these, an aluminum salt and a polymer thereof are preferred. In general, for obtaining a sharper particle size distribution, the valence of the inorganic metal salt is preferably divalence than monovalence, and trivalence or greater valence than divalence. With the same valence, a polymer type, that is, an inorganic metal salt polymer, is more preferred.

The amount added of the aggregating agent varies depending on the kind or valence of the aggregating agent but, in general, the amount added is preferably from 0.05 to 0.1 mass %. The aggregating agent flows out into the aqueous medium or forms a coarse powder in the process of producing a toner, and the entire amount thereof is not allowed to remain in the toner. Particularly, when the amount of the solvent in the resin is large, the aggregating agent readily interacts with the solvent in the process of producing a toner and flows out into the aqueous medium. Therefore, the amount added of the aggregating agent is preferably adjusted according to the residual solvent amount.

Because of addition of the aggregating agent, the toner according to this exemplary embodiment preferably contains at least one or more metal elements selected from the group consisting of aluminum, zinc and calcium, in an amount of 0.003 to 0.05 mass % in terms of the compositional ratio of elements. Here, the content of the metal element is determined from total elemental analysis by a fluorescent X-ray analyzer. The sample (6 g of toner) is press-formed by a pressure molding device with a load of 10 t for a pressure time of 1 minute, and the content of the metal element is determined from the compositional ratio of elements measured using a fluorescent X-ray analyzer (XRF-1500) manufactured by Shimadzu Corporation under the measuring conditions of a tube voltage of 40 kV, a tube current of 90 mA and a measuring time of 30 minutes.

In the fusing step, the suspension of aggregates is adjusted to a pH of 5 to 10 under stirring in accordance with the aggregating step, thereby stopping the progress of aggregation, and then heated at a temperature not lower than the glass transition temperature (Tg) of the resin (or at a temperature not lower than the melting temperature of the crystalline resin) to fuse and coalesce the aggregated particles. The heating time is sufficient if it is long enough to allow the desired coalescence, and the heating may be performed for 0.2 to 10 hours. At the subsequent solidification of the particle by temperature drop to Tg of the resin or less, the shape and surface property of the particle are sometimes changed depending on the temperature drop rate. The temperature is preferably lowered to Tg of the resin or less at a rate of at least 0.5° C./min or more, more preferably lowered to Tg of the resin or less at a rate of 1.0° C./min or more.

Also, when the particle is grown by the control of pH or addition of the aggregating agent or the like in accordance with the aggregating step while heating the system at a temperature not lower than Tg of the resin and at the point of reaching the desired particle diameter, the temperature is lowered to Tg of the resin or less at a rate of at least 0.5° C./min in accordance with the case of the fusing step to stop the grain growth while effecting the solidification, the aggregating step and the fusing step are simultaneously performed and this is preferred in view of simplification of the process, but it becomes difficult in some cases to form the above-described core-shell structure.

After the completion of the fusing step, the particle is washed and dried to obtain a toner particle. In this respect, displacement washing with ion-exchanged water is preferably applied. The degree of washing is generally monitored by the conductivity of the filtrate, and the washing is preferably performed such that the conductivity finally becomes 25 μS/cm or less. At the washing, a step of neutralizing the ion with an acid or an alkali may be provided, where in the treatment with an acid, the pH is preferably 4.0 or less and in the treatment with an alkali, the pH is preferably 8.0 or more. The solid-liquid separation after washing is not particularly limited, but in view of productivity, for example, suction filtration or pressure filtration such as filter press is preferably used. Drying is also not particularly limited, but in view of productivity, for example, freeze drying, flash jet drying, fluidized drying or vibration-type fluidized drying is preferably used, where drying may be performed such that the final toner has a moisture percentage of preferably 1 mass % or less, more preferably 0.7 mass % or less.

In the thus-obtained toner particle, an inorganic particle and an organic particle may be externally added and mixed as a flowing aid, a cleaning aid, an abrasive or the like. Examples of the inorganic particle include all of the particles usually used as an external additive on the toner surface, such as silica, alumina, titanium oxide, calcium carbonate, magnesium carbonate, tricalcium phosphate and cerium oxide. The surface of the inorganic particle is preferably hydrophobed. Example of the organic particle include all of the particles usually used as an external additive on the toner surface, such as vinyl-based resin (e.g., styrene-based polymer, (meth) acrylic polymer, ethylene-based polymer), polyester resin, silicone resin and fluorine-based resin.

The primary particle diameter of such a particle is preferably from 0.01 to 0.5 μm. Furthermore, a lubricant may be added. Examples of the lubricant include a fatty acid amide such as ethylene bis-stearamide or oleamide, a fatty acid metal salt such as zinc stearate and calcium stearate, and a higher alcohol such as UNILIN. The primary particle diameter thereof is preferably from 0.5 to 8.0 μm.

At least two or more kinds of inorganic particles described above are used, and at least one kind of the inorganic particle preferably has an average primary particle diameter of 30 to 200 nm, more preferably from 30 to 180 nm.

Specifically, silica, alumina and titanium oxide are preferred and in particular, hydrophobed silica is preferably added as an essential component. A combination use of silica and titanium oxide is more preferred. It is also preferred to use an organic particle having a particle diameter of 80 to 500 nm in combination. The hydrophobing agent for hydrophobing the external additive includes known materials, and examples of the treatment include a treatment with a coupling agent such as silane-based coupling agent, titanate-based coupling agent, aluminate-based coupling agent and zirconium-based coupling agent, a silicone oil or a polymer coating.

The external additive may be adhered or fixed to the toner surface by applying a mechanical impact force by means of a V blender, a sample mill or a Henschel mixer.

<Physical Properties of Electrostatic Image Developing Toner>

The volume average particle diameter of the electrostatic image developing toner according to this exemplary embodiment is preferably from 4 to 8 μm, more preferably from 5 to 7 μm, and the number average particle diameter is preferably from 3 to 7 μm, more preferably from 4 to 6 μm.

When a cumulative distribution of each of the volume and the number is drawn from the small diameter side with respect to the particle size range (channel) divided on the basis of the particle size distribution measured by the following method and when the particle diameters at 16% accumulation, 50% accumulation and 84% accumulation are defined as D16% by volume, D50% by volume and D84% by volume, respectively, the volume average particle size distribution index (GSDv) calculated by $(D84\%/D16\%)^{1/2}$ is preferably 1.27 or less, more preferably 1.25 or less. If GSDv exceeds 1.27, the particle size distribution is not sharp and the resolution decreases, giving rise to an image defect such as scattering of toner or fogging.

The measurement of the volume average particle diameter or the like is performed using a Multisizer II (manufactured by Beckman Coulter Inc.) at an aperture diameter of 50 μm. At this time, the measurement is performed after the toner is dispersed in an aqueous electrolyte solution (an aqueous Isoton solution) (concentration: 10 mass %) and ultrasonically dispersed for 30 seconds or more. As for the particle size distribution, a cumulative distribution of each of the volume and the number is drawn from the small diameter side with respect to the particle size range divided on the basis of the particle size distribution measured using Multisizer II (division number: a range from 1.26 to 50.8 μm is divided into 16 channels at intervals of 0.1 on the log scale; specifically, the range is divided into channel 1 of 1.26 μm to less than 1.59 μm, channel 2 of 1.59 μm to less than 2.00 μm, channel 3 of 2.00 μm to less than 2.52 μm, . . . such that the log value of the lower limit on the left side becomes (log1.26=) 0.1, (log1.59=) 0.2, (log2.00=) 0.3, . . . 1.6), the particle diameter at 16% accumulation is defined as D16v by volume and D16p by number, the particle diameter at 50% accumulation is defined as D50v by volume (volume average particle diameter) and D50p by number, and the particle diameter at 84% accumulation is defined as D84v by volume and D84p by number.

The toner preferably has a spherical shape with a shape factor SF1 of 110 to 140. When the shape is spherical in this range, the transfer efficiency and the denseness of image are enhanced and a high-quality image is formed. The shape factor SF1 is more preferably from 115 to 130.

The shape factor SF1 is determined by the following formula:

$$SF1=(ML^2/A)\times(\pi/4)\times 100$$

wherein ML indicates the absolute maximum length of the toner particle, and A indicates the projected area of the toner particle.

SF1 is quantified mainly by subjecting a microscopic image or a scanning electron microscopic (SEM) image to an analysis using an image analyzer and calculated, for example, as follows. That is, an optical micrograph of toner particles spread on a slide glass surface is incorporated into a Luzex image analyzer through a video camera, the maximum length and projected area are determined on 100 particles, and after calculation according to the formula above, an average value is determined to obtain the shape factor.

If the shape factor SF1 of the toner is less than 110 or exceeds 140, excellent chargeability, cleanability and transferability may not be obtained over a long period time.

<Developer for Electrostatic Image Development and Developer Set for Electrostatic Image Development>

In this exemplary embodiment, the developer for electrostatic image development is not particularly limited except for containing the red toner for electrostatic image development of the exemplary embodiment above and may be designed to have an appropriate component composition according to the purpose. The developer for electrostatic image development of this exemplary embodiment is used as a one-component developer directly or as a two-component developer composed of the developer and a carrier.

In this exemplary embodiment, the developer set for electrostatic image development contains at least a magenta developer containing a magenta toner, a yellow developer containing a yellow toner, and a red developer containing the above-described red toner. The developer set may further contain a cyan developer containing a cyan toner, a black developer containing a black toner, and the like. Each developer is used as a one-component developer directly or as a two-component developer composed of the developer and a carrier.

The carrier is preferably a carrier coated with a resin, more preferably a carrier coated with a nitrogen-containing resin. Examples of the nitrogen-containing resin include an acrylic resin including dimethylaminoethyl methacrylate, dimethyl acrylamide and acrylonitrile, an amino resin including urea, urethane, melamine, guanamine and aniline, an amide resin, and a urethane resin. A copolymerized resin thereof may also be used. As for the coat resin of the carrier, two or more kinds of nitrogen-containing resins described above may be used in combination. Also, the nitrogen-containing resin and a nitrogen-non-containing resin may be used in combination. Furthermore, the nitrogen-containing resin may be formed into a particle and used by dispersing the particle in a nitrogen-non-containing resin. Above all, a urea resin, a urethane resin, a melamine resin and an amide resin are preferred.

In general, the carrier needs to have an appropriate electric resistance and, specifically, is required to have an electric resistance of $10^9$ to $10^{14}$ Ωcm or about $10^9$ to about $10^{14}$ Ωcm. For example, in the case where the electric resistance is as low as $10^6$ Ωcm, such as iron powder carrier, it is preferred that the carrier is coated with an insulating (volume resistivity of $10^{14}$ Ωcm or more) resin and an electrically conductive powder is dispersed in the resin coat layer.

Specific examples of the electrically conductive powder include a metal such as gold, silver and copper; carbon black; an electrically semiconductive oxide such as titanium oxide and zinc oxide; and a powder obtained by coating tin oxide, carbon black or a metal on the surface of a powder of titanium oxide, zinc oxide, barium sulfate, aluminum borate or potassium titanate. Among them, carbon black is preferred.

Examples of the method for forming the resin coat layer on the surface of a carrier core material include an immersion method of immersing a powder of the carrier core material in a solution for forming the coat layer, a spray method of spraying the coat layer-forming solution on a surface of the carrier core material, a fluidized bed method of spraying the coat layer-forming solution on the carrier core material in a state of being floated by a flowing air, a kneader-coater method of mixing the carrier core material and the coat layer-forming solution in a kneader-coater and then removing the solvent, and a powder coating method of forming the coat resin into a particle, mixing it with the carrier core material in a kneader-coater at a temperature not lower than the melting point of the coat resin, and after cooling, coating the mixture. In particular, a kneader-coater method and a powder coating method are preferred. The average film thickness of the resin coat layer formed by the method above is usually from about 0.1 to about 10 μm, preferably from about 0.2 to about 5 μm.

The core material for use in the carrier (carrier core material) is not particularly limited, and examples thereof include a magnetic metal such as iron, steel, nickel and cobalt, a magnetic oxide such as ferrite and magnetite, and a glass bead. Particularly, in the case of using a magnetic brush method, a magnetic carrier is preferred. In general, the volume average particle diameter of the carrier core material is preferably from 10 to 100 μm, more preferably from 20 to 80 μm.

The mixing ratio (toner:carrier) of the toner to the carrier in the two-component developer is preferably in a range of approximately from 1:100 to 30:100, more preferably in a range of approximately from 3:100 to 20:100.

For the production of the carrier, a heating kneader, a heating Henschel mixer, a UM mixer or the like may be sued, and depending on the amount of the coat resin, a heated fluidized rolling bed, a heated kiln or the like may also be used.

The mixing ratio of the electrostatic latent image developing toner of this exemplary embodiment to the carrier in the developer for electrostatic latent image development is not particularly limited and may be appropriately selected according to the purpose.

<Image Forming Apparatus and Image Forming Method>

One example of each of the image forming apparatus and the image forming method of this exemplary embodiment is described below. The following image forming apparatus is merely one example, and the image forming apparatus is not limited thereto.

The image forming apparatus according to this exemplary embodiment includes an image holding member, a latent image forming unit for forming an electrostatic latent image on a surface of the latent image holding member, a developing unit for developing the electrostatic latent image with a developer containing a toner to form a toner image, a primary transfer unit for primarily transferring the developed toner image onto an intermediate transfer member, and a secondary transfer unit for secondarily transferring the toner image transferred to the intermediate transfer member, onto a recording material. Also, the image forming apparatus according to this exemplary embodiment may include a unit other than the above-described units, for example, may include a charging unit for electrically charging the image holding member, a fixing unit for fixing the toner image transferred to the surface of the recording material, and a cleaning unit for removing the toner remaining on the surface of the image holding member.

The drawing is a schematic configuration view showing one example of the image forming apparatus according to this exemplary embodiment. The image forming apparatus 200 is configured to include, for example, an image holding member 201, a charger 202 that is a charging unit, an image writing device 203 that is a latent image forming unit, a rotary developing apparatus 204 that is a developing unit, a primary transfer roll 205 that is a primary transfer unit, a cleaning blade 206 that is a cleaning unit, an intermediate transfer material 207 that is an intermediate transfer member for transferring en bloc toners of two or more colors onto a recording material, a plurality of (in the Figure, three) support rolls 208, 209 and 210, and a secondary transfer roll 211 that is a secondary transfer unit.

The image holding member 201 is formed in a drum shape as a whole and has a photosensitive layer on the outer circumferential surface (drum surface. This image holding member 201 is provided rotatably in the arrow C direction in the drawing. The charger 202 uniformly charges the surface of the image holding member 201. The image writing device 203 irradiates imagewise light on the image holding member 201 that is uniformly charged by the charger 202, to form an electrostatic latent image.

The rotary developing apparatus 204 has five developing devices 204Y, 204M, 204C, 204K and 204R housing toners for yellow, magenta, cyan, black and red colors, respectively. In this apparatus, since a toner is used in the developer for forming an image, a yellow toner is housed in the developing device 204Y, a magenta toner is housed in the developing device 204M, a cyan toner is housed in the developing device 204C, a black toner is housed in the developing device 204K, and a red toner is housed in the developing device 204R. This rotary developing apparatus 204 is driven to rotate such that those five developing devices 204R, 204Y, 204M, 204C and 204K sequentially come close to and oppose the image holding member 201, whereby the toners are transferred onto the electrostatic latent images corresponding to respective colors to form toner images.

Here, according to the image required, the developing devices other than the developing device 204R in the rotary developing apparatus 204 may be partially removed. For example, the rotary developing apparatus may include four developing devices, that is, a developing device 204Y, a developing device 204M, a developing device 204C and a developing device 204R. Also, the developing device may be changed to a developing device housing a developer of the desired color such as red, blue or green.

The primary transfer roll 205 transfers the toner image formed on the image holding member 201 surface onto the outer circumferential surface of the endless belt-like intermediate transfer material 207 (primary transfer) while keeping the intermediate transfer material 207 to be held between the primary transfer roll and the image holding member 201. The cleaning blade 206 cleans (removes) the toner and the like remaining on the image holding member 201 surface after transfer. The intermediate transfer material 207 allows its inner circumferential surface to be tensioned by a plurality of support rolls 208, 209 and 210 and is thereby supported orbitably in the arrow D direction and in the reverse direction. The secondary transfer roll 211 transfers the toner image transferred to the outer circumferential surface of the intermediate transfer material 207, onto a recording sheet (secondary transfer) while keeping the recording sheet (recording material) conveyed in the arrow E direction by a sheet conveying unit (not shown) to be held between the secondary transfer roll and the support roll 210.

The image forming apparatus 200 that sequentially forms toner images on the image holding member 201 surface and transfers the toner images in a superposed manner onto the outer circumferential surface of the intermediate transfer material 207, operates as follows. That is, first, the image holding member 201 is driven to rotate and after the surface of the image holding member 201 is uniformly charged by the charger 202 (charging step), imagewise light is irradiated on the image holding member 201 by the image writing device 203 to form an electrostatic latent image (latent image forming step). This electrostatic latent image is developed, for example, by a developing device 204R for red color (developing step), and the toner image formed is transferred onto the outer circumferential surface of the intermediate transfer material 207 by the primary transfer roll 205 (primary transfer step). At this time, the red toner and the like remaining on the image holding member 201 surface without being transferred onto the intermediate transfer material 207 are cleaned by the cleaning blade 206. The intermediate transfer material 207 having formed on the outer circumferential surface thereof a toner image of red color once moves in orbit to the direction reverse to the arrow D direction while holding the toner image of red color on its outer circumferential surface and prepares at the position where the next toner image of, for example, yellow color is transferred and stacked on the toner image of red color.

Subsequently, charging by the charger 202, irradiation of imagewise light by the image writing device 203, formation of a toner image by each of the developing devices 204Y, 204M, 204C and 204K, and transfer of the toner image onto the circumferential surface of the intermediately transfer material 207 are sequentially repeated for respective toners of yellow, magenta, cyan and black.

In this exemplary embodiment, in the case of formation of a red image, a yellow toner image formed on the image holding member 201 by the developing device 204Y is transferred as disposed in the primary transfer step onto a red toner image formed on the intermediate transfer material 207 through the developing step and the primary transfer step, and a cyan toner image formed on the image holding member 201 by the developing device 204C is then transferred as disposed in the primary transfer step onto the yellow toner image.

When the transfer of three color toner images onto the outer circumferential surface of the intermediate transfer material 207 is completed in this way, the toner images are transferred en bloc onto a recording sheet by the secondary transfer roll 211 (secondary transfer step), whereby a recorded image resulting from stacking of a magenta toner image, a yellow toner image and a red toner image in this order from the image forming surface is obtained on the image forming surface of the recording sheet. The toner images transferred onto the recording sheet surface by the secondary transfer roll 211 are then heated and fixed by the fixing unit for fixing the transferred toner image (fixing step).

In this way, for example, by forming an image such that a light red toner comes to the intermediate transfer material 207 side at the primary transfer, even if a part of the red toner remains on the intermediate transfer material 207 due to a transfer failure at the secondary transfer, the change in the ratio between the yellow toner and the magenta toner is suppressed. Also, at the fixing, even if a part of the magenta toner as a lower layer penetrates between fibers of the recording sheet to cause yellow-shifting of the image hue, thanks to stacking of a red toner having a hue shifted to magenta, the hue is corrected.

Furthermore, the toner contains a crystalline resin as the binder resin, particularly, at least the magenta toner contains a crystalline resin as the binder resin, whereby, as described above, the change in the hue is more suppressed. More specifically, compared with the case where the binder resin of the toner is composed of only a noncrystalline resin, the toner is hard to melt and prevented from penetrating into the recording sheet, as a result, the change of the image hue is suppressed.

The charging unit, image holding member, latent image forming unit, developing unit, transfer unit, intermediate transfer material, cleaning unit, fixing unit and transfer-receiving material in the image forming apparatus 200 of the drawing are described below.

(Charging Unit)

As for the charger 202 that is a charging unit, for example, a charger such as corotron is used, but an electrically conductive or semiconductive charging roll may be used. In a contact-type charger using an electrically conductive or semiconductive charging roll, a dc current or a dc current superposed on an ac current may be applied to the image holding member 201. The image holding member 201 surface is electrically charged by such a charger 202 or by generating a discharge in a microspace near the contact part with the image holding member 201. Usually, the surface is charged to from −300 V to −1,000 V. The above-described electrically conductive or semiconductive charging roll may have a single-layer structure or a multiple structure. Also, a mechanism of cleaning the charging roll surface may be provided.

(Image Holding Member)

The image holding member 201 has a function of allowing at least a latent image (electrostatic image) to be formed thereon. The image holding member is suitably an electrophotographic photoreceptor. The image holding member 201 has a coating film containing an organic photoreceptor on the outer circumferential surface of a cylindrical electrically conductive substrate. The coating film is a film where a subbing layer, if desired, and a photosensitive layer including a charge generating layer containing a chare generating substance and a charge transport layer containing a charge transport substance are formed in this order on a substrate. The order of stacking the chare generating layer and the charge transport layer may be reversed. This is a laminate-type photoreceptor where a charge generating substance and a charge transport substance are incorporated into separate layers (a charge generating layer and a charge transport layer), but the image holding member may be a single-layer photoreceptor containing both a charge generating substance and a charge transport substance in the same layer. A laminate-type photoreceptor is preferred. The photoreceptor may also have an intermediate layer between the subbing layer and the photosensitive layer. Furthermore, this exemplary embodiment is not limited to an organic photoreceptor, but a different kind of photosensitive layer, such as amorphous silicon photosensitive film, may also be used.

(Latent Image Forming Unit)

The image writing device 203 that is a latent image forming unit is not particularly limited, and examples thereof include an optical device capable of irradiating light to expose a desired image on the surface of the image holding member surface by using a light source such as semiconductor laser light, LED light or liquid crystal shutter light.

(Developing Unit)

The developing unit has a function of developing the latent image formed on the image holding member with a developer containing a toner to form a toner image. As long as this function is fulfilled, the developing apparatus is not particularly limited and may be appropriately selected according to the purpose, but examples thereof include a known developing device having a function of attaching an electrostatic image developing toner to the image holding member 201 by using a brush, roller or the like. For the image holding member 201, a dc voltage is usually used and may also be used by superposing an ac voltage thereon.

(Transfer Unit)

The transfer unit may be, for example, a unit of providing a transfer-receiving material with a polarity opposite that of the toner from the back side of the transfer-receiving material and transferring the toner image to the transfer-receiving material by the effect of an electrostatic force, or a unit including a transfer roll using an electrically conductive or semiconductive roll or the like and a transfer roll pressing device, which are brought into direct contact through a transfer-receiving material to transfer the toner image onto the transfer-receiving material surface. For the transfer roll, as a transfer current imparted to the image holding member, a dc current or a dc current superposed with an ac current may be applied. The transfer roll may be arbitrarily set according to the width of the image region to be charged, the shape of the transfer charger, the opening width, the process speed (circumferential velocity) and the like. In terms of cost reduction, a single-layer foam roll or the like is suitably used as the transfer roll.

(Intermediate Transfer Material)

The intermediate transfer material may be a known intermediate transfer material. Examples of the material used for the intermediate transfer material include a polycarbonate resin (PC), a polyvinylidene fluoride (PVDF), a polyalkylene phthalate, and a blend material such as PC/polyalkylene terephthalate (PAT), ethylene tetrafluoroethylene copolymer (ETFE)/PC, ETFE/PAT and PC/PAT. In view of mechanical strength, an intermediate transfer belt using a thermosetting polyimide resin is preferred.

(Cleaning Unit)

As regards the cleaning unit, for example, a cleaning unit employing a blade cleaning system, a brush cleaning system or a roll cleaning system may be appropriately selected as long as it cleans the residual toner on the image holding member. Above all, use of a cleaning blade is preferred. Examples of the material for the cleaning blade include urethane rubber, neoprene rubber and silicone rubber. Among these, a polyurethane elastic body is preferred because of its excellent abrasion resistance. However, in the case of using a toner with high transfer efficiency, an exemplary embodiment using no cleaning unit may be employable.

(Fixing Unit)

The fixing unit (image fixing device) applies heating, pressurization or pressurization/heating to the toner image transferred onto a recording material, thereby fixing the toner image, and includes a fixing member.

The red toner and the toner set according to this exemplary embodiment are more effective when used in a high-speed machine having a sheet conveying speed of 220 to 600 mm/sec or about 220 to about 600 mm/sec, where, as the fixing conditions, the heating amount per unit time becomes large and the transfer time becomes short.

(Transfer-Receiving Material)

Examples of the recording material (recording sheet) on which the toner image is transferred include plain paper used for a copier, a printer or the like of the electrophotographic system, and an OHP sheet. For more enhancing the smoothness of the image surface after fixing, the surface of the recording material is preferably as smooth as possible and, for example, coated paper obtained by coating the surface of plain paper with a resin or the like, or art paper for printing may be preferably used.

In this exemplary embodiment, examples of the plain paper include those having a smoothness of 15 to 80 seconds as measured in accordance with JIS-P-8119 and a basis weight of 80 g/m$^2$ or more as measured in accordance with JIS-P-8124, and examples of the coated paper include those having a coated layer on at least one surface of a paper substrate and having a smoothness of 150 to 1,000 seconds.

As regards the image forming apparatus, for example, an image forming apparatus generally called a tandem system of providing image forming apparatuses in combination, where developers containing a red toner, a yellow toner, a magenta toner, a cyan toner and a black toner are housed in the developing devices of the image forming apparatuses, respectively, and images are sequentially superposed and recorded on an image output medium, may also be used.

EXAMPLES

The present invention is described in greater detail below by referring to Examples and Comparative Examples, but the present invention is not limited to the following Examples.

<Production of Noncrystalline Resin Particle Liquid Dispersion A>

| | |
|---|---|
| Bisphenol A-propylene oxide 2-mol adduct | 45 mol % |
| Bisphenol A-ethylene oxide 2-mol adduct | 5 mol % |
| Terephthalic acid | 25 mol % |
| Fumaric acid | 14 mol % |
| Dodecenylsuccinic acid | 10 mol % |
| Trimellitic anhydride | 1 mol % |

Into a two-necked flask that is heated and dried, the components above and tin(II) dioctylate in an amount of 0.08 parts by mol based on the acid components (the total molar number of terephthalic acid, fumaric acid, dodecenylsuccinic acid and trimellitic anhydride) are charged. After raising the temperature while keeping an inert atmosphere by introducing a nitrogen gas into the vessel, a copolycondensation is allowed to proceed at 150 to 230° C. for 12 hours and then, the pressure is gradually reduced at 210 to 250° C. to obtain Noncrystalline Polyester Resin A.

| | |
|---|---|
| Noncrystalline Polyester Resin A | 100 parts by mass |
| Ethyl acetate | 900 parts by mass |
| 25% Anion surfactant | 10 parts by mass |
| Ammonium acetate | 10 parts by mass |
| Ion-exchanged water | 1,000 parts by mass |

These are charged into a closed vessel and emulsified by a homogenizer to obtain a liquid dispersion. The obtained liquid dispersion is transferred to a distillation flask, the temperature is raised to 50° C., distillation is performed and after cooling, ion-exchanged water added to obtain Resin Particle Liquid Dispersion A having a solid content concentration of 10 wt %.

With respect to the obtained resin particle liquid dispersion, the number average particle diameter D50n of resin particles is measured by a laser diffraction particle size distribution analyzer (LA-700, manufactured by Horiba Ltd.) and found to be 180 nm, the glass transition temperature of the resin is measured using a difference scanning calorimeter (DSC-50, manufactured by Shimadzu Corp.) at a temperature rise rate of 10° C./min and found to be 60° C., the number average molecular weight (in terms of polystyrene) with THF as a solvent is measured using a molecular weight meter by gel permeation chromatography (HLC-8020, manufactured by Tosoh Corp.) and found to be 7,000, and the weight average molecular weight is found to be 21,000. The solid content concentration is calculated from the weight of a dry product remaining after weighing out 3 g of the liquid dispersion and vaporizing the water content under heating at 130° C. for 30 minutes.

<Production of Crystalline Resin Particle Liquid Dispersion B>

| | |
|---|---|
| Dodecanedicarboxylic acid | 50 mol % |
| Dodecanediol | 50 mol % |

Into a two-necked flask that is heated and dried, the components above and $Ti(OBu)_4$ in an amount of 0.012 parts by mass based on the acid components are charged. After raising the temperature while keeping an inert atmosphere by introducing a nitrogen gas into the vessel, heating and stirring are performed at 180° C. for 6 hours. Thereafter, the pressure is gradually reduced at 180 to 230° C. to obtain Crystalline Polyester Resin B.

Crystalline Polyester Resin B is found to have a melting temperature Tc by DSC of 70° C., a weight average molecular weight Mw by GPC of 25,000, a number average molecular weight Mn of 12,000, and an acid value AV of 9.6 mgKOH/g.

| | |
|---|---|
| Crystalline Polyester Resin B | 100 parts by mass |
| Ethyl acetate | 900 parts by mass |
| 25% Anionic surfactant (NEOGEN RK, produced by Dai-Ichi Kogyo Seiyaku Co., Ltd.) | 10 parts by mass |
| Ammonium acetate | 10 parts by mass |
| Ion-exchanged water | 1,000 parts by mass |

These are charged into a closed vessel and after raising the temperature to 60° C., emulsified by a homogenizer to obtain a liquid dispersion. The obtained liquid dispersion is transferred to a distillation flask, the temperature is raised to 50° C., distillation is performed and after cooling, ion-exchanged water added to obtain Resin Particle Liquid Dispersion B having a solid content concentration of 10 wt %.

<Preparation of Release Agent Liquid Dispersion>

| | |
|---|---|
| Wax (HNP9, trade name, produced by Nippon Seiro Co., Ltd., melting temperature Tw: 75° C.) | 100 parts by mass |
| 25% Anionic surfactant (NEOGEN RK, produced by Dai-Ichi Kogyo Seiyaku Co., Ltd.) | 20 parts by mass |
| Ion-exchanged water | 380 parts by mass |

These are charged into a closed vessel and dispersed by a homogenizer to obtain a release agent liquid dispersion.

<Preparation of Coloring Agent Liquid Dispersion (R1)>

| | |
|---|---|
| Red pigment (FUJI FAST CARMINE 522 (C.I. Pigment Red 150), produced by Fuji Shikiso K.K.) | 100 parts by mass |
| 25% Anionic surfactant (NEOGEN RK, produced by Dai-Ichi Kogyo Seiyaku Co., Ltd.) | 40 parts by mass |
| Ion-exchanged water | 360 parts by mass |

These are charged into a closed vessel and dispersed by a homogenizer to obtain Coloring Agent Liquid Dispersion R1. The volume average particle diameter D50v of the particles in this coloring agent liquid dispersion is 177 nm. For the volume average particle diameter D50, an average value of the measured values of three measurements excluding the maximum value and the minimum value out of five measurements by Microtrac is used.

<Preparation of Coloring Agent Liquid Dispersion (R2)>

Coloring Agent Liquid Dispersion (R2) is obtained by the same operation except that in the preparation of Coloring Agent Liquid Dispersion (R1), the red pigment is changed to C.I. Pigment Red 221 (CROMOPHTAL Red 2B, produced by Ciba Japan). The volume average particle diameter D50v of the particles in this coloring agent liquid dispersion is 174 nm.

<Preparation of Coloring Agent Liquid Dispersion (R3)>

Coloring Agent Liquid Dispersion (R3) is obtained by the same operation except that in the preparation of Coloring Agent Liquid Dispersion (R1), the red pigment is changed to a mixture of C.I. Pigment Red 31 and C.I. Pigment Red 150 (FUJI FAST CARMINE 527, produced by Fuji Shikiso K.K.). The volume average particle diameter D50v of the particles in this coloring agent liquid dispersion is 181 nm.

<Preparation of Coloring Agent Liquid Dispersion (M1)>

Coloring Agent Liquid Dispersion (M1) is obtained by the same operation except that in the preparation of Coloring Agent Liquid Dispersion (R1), the red pigment is changed to a magenta pigment (FUJI FAST RED 9900RM (C.I. Pigment Red 122), produced by Fuji Shikiso K.K.). The volume average particle diameter D50v of the particles in this coloring agent liquid dispersion is 169 nm.

<Preparation of Coloring Agent Liquid Dispersion (Y1)>

Coloring Agent Liquid Dispersion (Y1) is obtained by the same operation except that in the preparation of Coloring Agent Liquid Dispersion (R1), the red pigment is changed to a yellow pigment (5GX03 (C.I. Pigment Yellow 74), produced by Clariant Japan K.K.). The volume average particle diameter D50v of the particles in this coloring agent liquid dispersion is 155 nm.

Example 1

Production of Red Toner (TR1)

| | |
|---|---|
| Noncrystalline Resin Particle Liquid Dispersion A | 760 parts by mass |
| Coloring Agent Liquid Dispersion (R1) | 50 parts by mass |
| Release Agent Liquid Dispersion | 20 parts by mass |

In a round stainless steel-made flask, after adjusting the pH in the system to 4.0 with an aqueous 1.0 mol/L nitric acid solution, these are mixed and dispersed by a homogenizer. Subsequently, the dispersing operation by a homogenizer is continued while adding 1.00 parts by mass of an aqueous polyaluminum chloride ($Al_2O_3$ component: 20 wt %). The flask is heated to 50° C. over a heating oil bath with stirring. After holding the system at 50° C. for 60 minutes, 200 parts by mass of Noncrystalline Resin Particle Liquid Dispersion A is added thereto little by little. Thereafter, the pH in the system is adjusted to 8.5 with an aqueous 0.5 mol/L sodium hydroxide solution, and the stainless steel-made flask is then tightly closed, heated to 90° C. while continuing the stirring and held for 3 hours.

After the completion of reaction, the reaction solution is cooled and subjected to solid-liquid separation by Nutsche suction filtration. The toner obtained is re-dispersed in ion-exchanged water in an amount of 50 times the weight of the toner and washed. This operation is further repeated 5 times. At the time when the filtrate came to have a pH of 7.5 and an electrical conductivity of 7.0 μS/cm or less, solid-liquid separation is performed by Nutsche suction filtration using No. 5A filter paper. Subsequently, vacuum drying is continued for 12 hours to obtain Dry Toner (R1).

100 Parts by mass of Dry Toner (R1), 1.0 parts by mass of decylsilane-treated hydrophobic titania having a volume average particle diameter of 15 nm, and 1.5 parts by mass of hydrophobic silica (NY50, produced by Nippon Aerosil Co., Ltd.) having a volume average particle diameter of 30 nm are mixed and after blending using a sample mill at 10,000 rpm for 1 minute, aggregates are removed using a vibration sieve with an opening of 212 μm to obtain Red Toner (TR1).

The particle diameter of Red Toner (TR1) is measured by Multisizer II, as a result, the volume average particle diameter D50 is 5.95 μm and the volume particle size distribution index GSDv is 1.21.

<Production of Carrier>

| | |
|---|---|
| Ferrite particle (volume average particle diameter: 45 μm, volume resistivity: $10^8$ Ωcm) | 100 parts by mass |
| Toluene | 14 parts by mass |
| Perfluorooctylethyl acrylate/methyl methacrylate copolymer (copolymerization ratio: 40/60, Mw: 50,000) | 1.6 parts by mass |
| Carbon black (VXC-72, produced by Cabot Corp.) | 0.12 parts by mass |

Out of these components, the components except for the ferrite particle are mixed using a stirrer for 10 minutes to prepare a solution for coat formation. This solution for coat formation and the ferrite particle are charged into a vacuum deaeration-type kneader and stirred at 60° C. for 30 minutes, and toluene is then distilled off by reducing the pressure to form a resin coat on the ferrite particle surface. In this way, a carrier is obtained.

<Production of Developer>

40 Parts by mass of Red Toner (TR1) is added to 500 parts by mass of the carrier obtained above and blended by a V blender for 20 minutes, and aggregates are then removed by a vibration sieve with an opening of 212 μm to obtain Developer (DR1). Also, 100 parts by mass of Red Toner (TR1) is added to 20 parts by mass of the carrier obtained above and blended by a V blender for 20 minutes, and aggregates are then removed by a vibration sieve with an opening of 212 μm to obtain Replenishing Developer (DAR1).

<Production of Magenta Toner (TM1) and Developer>

Magenta Toner (TM1), Developer (DM1) and Replenishing Developer (DAM1) are obtained by the same operations except that in the production of Red Toner (TR1), Coloring Agent Liquid Dispersion (R1) is changed to Coloring Agent Liquid Dispersion (M1).

<Production of Yellow Toner (TY1) and Developer>

Yellow Toner (TY1), Developer (DY1) and Replenishing Developer (DAY1) are obtained by the same operations except that in the production of Red Toner (TR1), Coloring Agent Liquid Dispersion (R1) is changed to Coloring Agent Liquid Dispersion (Y1).

<Evaluation of Image>

The main body, developing devices and toner cartridges of DocuCentre Color 400CP manufactured by Fuji Xerox Co., Ltd., after removing the developers and toners that have been set therein, are cleaned, and the developers produced are charged into the developing devices, while charging the replenishing developers into respective toner cartridges. The magenta developing device is set to the position where the cyan developing device of DocuCentre Color 400CP has been originally set, the yellow developing device is set to the position where the magenta developing device has been originally set, and the red developing device is set to the position where the yellow developing device has been originally set. The amount of the developing toner for each monochromatic 100% image on OK TOPCOAT (coated paper, produced by Oji Paper Co., Ltd., smoothness: 5,000 seconds or more, basis weight: 127 g/m$^2$) is adjusted to 4.0 g/m$^2$. A binary color image composed of 100% yellow toner and 100% magenta toner and an image composed of only 100% red toner, each having a size of 5 cm×5 cm, are produced (fixer: fixing device mounted in DocuCentre Color 400CP, sheet conveying rate: 160 mm/sec, temperature of heating roll: 180° C., temperature of pressure roll: 150° C.), and L*a*b* of the obtained image is measured as the density. In the measurement, X-Rite 939 (aperture: 4 mm) is used and by randomly measuring the density in the image plane 10 times, the average value thereof is used as the density or color saturation. The binary color density IDmy and the red image density ID are calculated, and the hue angle Amy of the binary color and the hue angle A of the red image are calculated from the a*b* values. The values are shown in Table 1.

Subsequently, the amount of the developing toner for 100% image of the yellow toner and the magenta toner on OK TOPCOAT is adjusted to 3.5 g/m$^2$ for each toner. Furthermore, the amount of the developing toner for 100% image of the red toner is adjusted to 1.5 g/m$^2$ so that the image density when outputting images of three colors including the red toner image each at 100% became the same as the density of the binary color image composed of 100% yellow toner or 100% magenta toner with the developing toner amount being adjusted to 4.0 g/m$^2$ and after producing a ternary color image of three colors each at 100% output and a ternary color image at 50% output (fixer: fixing device mounted in DocuCentre Color 400CP, sheet conveying rate: 160 mm/sec, temperature of heating roll: 180° C., temperature of pressure roll: 150° C.), the hue angle of each image is measured. Without adjusting the amount of the developing toner, images are subsequently output in the same manner (fixer: fixing device mounted in DocuCentre Color 400CP, sheet conveying rate: 160 mm/sec, temperature of heating roll: 180° C., temperature of pressure roll: 150° C.) using P paper (plain paper, produced by Fuji Xerox Co., Ltd., smoothness: 32 seconds, basis weight: 67 g/m$^2$), and the hue angle is measured. Base on the measurement results, a hue angle difference (AD100) obtained by subtracting the hue angle of the ternary color image of three colors each at 100% output produced on OK TOPCOAT from the hue angle of the ternary color image of three colors each at 100% output produced on P paper is calculated. The hue angle difference (AD50) is calculated in the same manner for the 50% output image. Also, the absolute value (ΔAD) of the hue angle difference obtained by subtracting the hue angle (Amy) of the binary color image composed of 100% yellow toner and 100% magenta toner with the developing toner amount for each monochromatic 100% image on the coated paper being adjusted to 4.0 g/m$^2$, from the hue angle of the ternary color image of three colors each at 100% output produced on the coated paper, is calculated. The values are shown in Table 1.

Example 2

Red Toner (TR2), Developer (DR2) and Replenishing Developer (DAR2) are produced by the same operation except that in the production of Red Toner (TR1), the amount of Coloring Agent Liquid Dispersion (R1) is changed to 5.0 parts by mass from 20.0 parts by mass, and evaluation is performed in the same manner as in Example 1. The results are shown in Table 1.

Example 3

Red Toner (TR3), Developer (DR3) and Replenishing Developer (DAR3) are produced by the same operation except that in the production of Red Toner (TR1), the amount of Coloring Agent Liquid Dispersion (R1) is changed to 9.0 parts by mass from 20.0 parts by mass, and evaluation is performed in the same manner as in Example 1. The results are shown in Table 1.

Example 4

Red Toner (TR4), Developer (DR4) and Replenishing Developer (DAR4) are produced by the same operation except that in the production of Red Toner (TR1), 20.0 parts by mass of Coloring Agent Liquid Dispersion (R1) is changed to 12.5 parts by mass of Coloring Agent Liquid Dispersion (R2), and evaluation is performed in the same manner as in Example 1. The results are shown in Table 1.

Example 5

Red Toner (TR5), Developer (DR5) and Replenishing Developer (DAR5) are produced by the same operation except that in the production of Red Toner (TR1), 20.0 parts by mass of Coloring Agent Liquid Dispersion (R1) is changed to 17.5 parts by mass of Coloring Agent Liquid Dispersion (R2), and evaluation is performed in the same manner as in Example 1. The results are shown in Table 1.

Example 6

Red Toner (TR6), Developer (DR6) and Replenishing Developer (DAR6) are produced by the same operation except that in the production of Red Toner (TR1), 20.0 parts by mass of Coloring Agent Liquid Dispersion (R1) is changed to 10.0 parts by mass of Coloring Agent Liquid Dispersion (R3), and evaluation is performed in the same manner as in Example 1. The results are shown in Table 1.

Example 7

Red Toner (TR7), Developer (DR7) and Replenishing Developer (DART) are produced by the same operation except that in the production of Red Toner (TR1), 20.0 parts by mass of Coloring Agent Liquid Dispersion (R1) is changed to 16.5 parts by mass of Coloring Agent Liquid Dispersion (R3), and evaluation is performed in the same manner as in Example 1. The results are shown in Table 1.

Example 8

Magenta Toner (TM2), Developer (DM2) and Replenishing Developer (DAM2) are produced by the same operation except that in the production of Magenta Toner (TM1), 700 parts by mass of Noncrystalline Resin Particle Liquid Dispersion A and 60 parts by mass of Crystalline Resin Particle Liquid Dispersion B are used in place of 760 parts by mass of Noncrystalline Resin Particle Liquid Dispersion A, and evaluation is performed in the same manner as in Example 1. The results are shown in Table 1.

Comparative Example 1

Red Toner (TRH1), Developer (DRH1) and Replenishing Developer (DARH1) are produced in the same manner as in Example 1 except for not using the red toner, and evaluation is performed in the same manner as in Example 1. The results are shown in Table 1.

Comparative Example 2

Red Toner (TRH2), Developer (DRH2) and Replenishing Developer (DARH2) are produced by the same operation except that in the production of Red Toner (TR1), the amount of Coloring Agent Liquid Dispersion (R1) is changed to 35.0 parts by mass from 20.0 parts by mass, and evaluation is performed in the same manner as in Example 1. The results are shown in Table 1.

Comparative Example 3

Red Toner (TRH3), Developer (DRH3) and Replenishing Developer (DARH3) are produced by the same operation except that in the production of Red Toner (TR1), the amount of Coloring Agent Liquid Dispersion (R1) is changed to 3.0 parts by mass from 20.0 parts by mass, and evaluation is performed in the same manner as in Example 1. The results are shown in Table 1.

Comparative Example 4

Red Toner (TRH4), Developer (DRH4) and Replenishing Developer (DARH4) are produced by the same operation except that in the production of Red Toner (TR1), 20.0 parts by mass of Coloring Agent Liquid Dispersion (R1) is changed to 10.0 parts by mass of Coloring Agent Liquid Dispersion (R3) and 5.0 parts by mass of Coloring Agent Liquid Dispersion (M1), and evaluation is performed in the same manner as in Example 1. The results are shown in Table 1.

Comparative Example 5

Red Toner (TRH5), Developer (DRH5) and Replenishing Developer (DARE3) are produced by the same operation except that in the production of Red Toner (TR1), 20.0 parts by mass of Coloring Agent Liquid Dispersion (R1) is changed to 10.0 parts by mass of Coloring Agent Liquid Dispersion (R2) and 5.0 parts by mass of Coloring Agent Liquid Dispersion (Y1), and evaluation is performed in the same manner as in Example 1. The results are shown in Table 1.

<Evaluation Results>

As for AD100 and AD50 in Table 1, rating is "very good" when 1.0 or less, "good" when from more than 1.0 to 2.0, and "fail" when more than 2.0. Also, as for ΔAD, rating is "very good" when 1.5 or less, "good" when from more than 1.5 to 2.5, and "fail" when more than 2.5.

In the toners of Examples, the hue angle differences AD100 and AD50 are small, revealing that the hue difference among sheets as well as in the sheet plane is improved. In the case where the image density of the red toner is high, the amount of the red toner developed and in turn, the effect by the addition of the red toner are small and the hue angle difference (AD50) of 50% image tends to become large. Conversely, in the case where the density of the red toner is too low, the amount of the red toner developed becomes large and there is a tendency that the transfer efficiency is worsened particularly in the case of plain paper and AD100 becomes large. When AD100 and AD50 are large, this causes a problem that the color shift among sheets increases.

When a red toner giving an image with a small hue angle difference (Amy−A) is used, the effect of correcting the magenta color is reduced and therefore, AD50 tends to become large. Conversely, when the hue angle difference (Amy−A) of the image is large, the hue of the red toner comes to have a great effect and therefore, there is a tendency that both AD100 and AD50 become large and at the same time, the hue angle difference (ΔAD) greatly varies depending on the presence or absence of the red toner. When ΔAD is large, the red region is shifted with respect to the hue of the entire image and this causes a problem that the image loses the color balance.

On the other hand, in the toner of Comparative Example 1 where an image is formed only with a yellow toner and a magenta toner, both AD100 and AD50 are large and a difference is caused in the hue angle. In the toner of Comparative Example 2 where a red toner with a high density is added, the hue angle difference ascribable to difference of the sheet is improved, but due to high density of the red toner, the color of the red toner greatly affects the region where the density of the image formed with a yellow toner and a magenta toner is low, and the hue angle difference (ΔAD) of 100% image and 50% image becomes large. In an actual image, there arises a problem that when a gradation pattern is produced, the hue is changed. By the use of a crystalline resin, suppression of the change in hue is further improved.

TABLE 1

| | Example | | | | | | | | Comparative Example | | | | |
|---|---|---|---|---|---|---|---|---|---|---|---|---|---|
| | 1 | 2 | 3 | 4 | 5 | 6 | 7 | 8 containing crystalline resin | 1 | 2 | 3 | 4 | 5 |
| Species of Y pigment | Y74 | Y74 | Y74 | Y74 | Y74 | Y74 | Y74 | Y74 | Y74 | Y74 | Y74 | Y74 | Y74 |
| Species of M pigment | R122 | R122 | R122 | R122 | R122 | R122 | R122 | R122 | R122 | R122 | R122 | R122 | R122 |
| IDmy | 1.8 | 1.8 | 1.8 | 1.8 | 1.8 | 1.8 | 1.8 | 1.8 | 1.8 | 1.8 | 1.8 | 1.8 | 1.8 |
| Hue angle Amy (°) | 40 | 40 | 40 | 40 | 40 | 40 | 40 | 40 | 40 | 40 | 40 | 40 | 40 |
| Species of light R pigment | R150 | R150 | R150 | R221 | R221 | R150/R31 | R150 | R150 | none | R150 | R150 | R150/R31 + R122 | R221 + Y74 |
| ID | 1.2 | 0.3 | 0.4 | 0.6 | 0.9 | 0.5 | 0.9 | 0.7 | — | 1.7 | 0.2 | 0.7 | 0.7 |
| Hue angle A (°) | 21 | 15 | 18 | 26 | 35 | 8 | 18 | 17 | — | 23 | 14 | −2 | 43 |
| ID/IDmy | 0.67 | 0.17 | 0.22 | 0.33 | 0.50 | 0.28 | 0.50 | 0.39 | — | 0.94 | 0.11 | 0.39 | 0.39 |
| Amy-A | 19 | 25 | 22 | 14 | 5 | 32 | 22 | 23 | — | 17 | 26 | 42 | −3 |
| AD100 | 1.1 | 1.9 | 0.9 | 1.0 | 0.7 | 0.9 | 0.8 | 0.9 | 2.8 | 1.4 | 2.5 | 1.3 | 1.5 |
| AD50 | 1.9 | 1.4 | 0.8 | 1.0 | 1.6 | 0.8 | 1.7 | 0.4 | 3.5 | 2.8 | 1.7 | 1.8 | 2.3 |
| ΔAD | 2.3 | 0.7 | 1.2 | 0.8 | 0.5 | 1.8 | 1.5 | 0.9 | 0.0 | 2.9 | 1.1 | 2.4 | 0.2 |

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A toner set for electrostatic image development, comprising:

a magenta toner;

a yellow toner; and a red toner, each containing a binder resin, a coloring agent and a release agent, wherein the toner set for electrostatic image development satisfies the following formulae:

$$0.3<ID<1.2$$

$$5°<A<35°$$

$$0.2<(ID/IDmy)<0.7$$

$$A<Amy$$

wherein

ID represents an image density when a first image is formed on a recording material with a toner loaded amount of 4.0 g/m$^2$ of the red toner;

A represents a hue angle of the first image expressed by an L*a*b* color coordinate space, provided that a hue angle of 0° is on the a*+axis and a hue angle of 90° is on the b*+axis;

IDmy represents an image density when a second image is formed by the magenta toner and the yellow toner on a recording material with a toner loaded amount of 4.0 g/m$^2$ for each of the magenta toner and the yellow toner; and Amy represents a hue angle of the second image expressed by the L*a*b* color coordinate space, the red toner comprises a red pigment selected from the group consisting of C.I. Pigment Red 150, C.I. Pigment Red 221, and C.I. Pigment Red 31;

the magenta toner comprises a magenta pigment selected from the group consisting of C.I. Pigment Red 185, C.I. Pigment Red 238, C.I. Pigment Red 269, and C.I. Pigment Red 122; and the yellow toner comprises a yellow pigment selected from the group consisting of C.I. Pigment Yellow 74 and C.I. Pigment Yellow 185.

2. The toner set for electrostatic image development according to claim 1, wherein the binder resin of at least the magenta toner contains a crystalline resin.

3. A developer set for electrostatic image development, comprising:

a magenta developer, a yellow developer, and a red developer, respectively containing a magenta toner, a yellow toner and a red toner, and a carrier, each of the magenta, yellow and red toners containing a binder resin, a coloring agent and a release agent, wherein the developer set for electrostatic image development satisfies the following formulae:

$$0.3<ID<1.2$$

$$5°<A<35°$$

$$0.2<(ID/IDmy)<0.7$$

$$A<Amy$$

wherein

ID represents an image density when a first image is formed on a recording material with a toner loaded amount of 4.0 g/m$^2$ of the red toner;

A represents a hue angle of the first image expressed by an L*a*b* color coordinate space, provided that a hue angle of 0° is on the a*+axis and a hue angle of 90° is on the b*+axis;

IDmy represents an image density when a second image is formed by the magenta toner and the yellow toner on a recording material with a toner loaded amount of 4.0g/m$^2$ for each of the magenta toner and the yellow toner; and Amy represents a hue angle of the second image expressed by the L*a*b* color coordinate space, the red toner comprises a red pigment selected from the group consisting of C.I. Pigment Red 150, C.I. Pigment Red 221, and C.I. Pigment Red 31;

the magenta toner comprises a magenta pigment selected from the group consisting of C.I. Pigment Red 185, C.I. Pigment Red 238, C.I. Pigment Red 269, and C.I. Pigment Red 122; and the yellow toner comprises a yellow pigment selected from the group consisting of C.I. Pigment Yellow 74 and C.I. Pigment Yellow 185.

4. The toner set for electrostatic image development according to claim 1, wherein A and Amy satisfy the following formula:

$$5°<(Amy-A)<35°.$$

5. The toner set for electrostatic image development according to claim 1, wherein a content of the coloring agent of the red toner is from 0.5 to 8 wt % based on the entire weight of the red toner.

6. The toner set for electrostatic image development according to claim 1, wherein the coloring agent of the red toner has a dispersion diameter of from 30 to 500 nm.

7. The toner set for electrostatic image development according to claim 1, wherein the binder resin of the red toner contains a crystalline resin.

8. The toner set for electrostatic image development according to claim 7, wherein a content of the crystalline resin in the binder resin of the red toner is from 2 to 20 wt %.

9. The toner set for electrostatic image development according to claim 7, wherein a melting temperature of the crystalline resin is from 50 to 120° C.

10. The toner set for electrostatic image development according to claim 7, wherein the crystalline resin is a crystalline polyester resin.

11. The toner set for electrostatic image development according to claim 10, wherein a weight average molecular weight (Mw) of the crystalline polyester resin is from 5,000 to 100,000.

12. The toner set for electrostatic image development according to claim 1, wherein the release agent of the red toner has a main maximum endothermic peak at 60 to 120° C. in DSC measured in accordance with ASTM D3418-8.

13. The toner set for electrostatic image development according to claim 12, wherein an added amount of the release agent of the red toner is from 1 to 15 parts by mass per 100 parts by mass of the binder resin.

14. An image forming apparatus, comprising:

an image holding member;

a latent image forming unit that forms an electrostatic latent image on a surface of the image holding member;

a developing unit that contains the developer set for electrostatic image development according to claim 3 and develops the electrostatic latent image by using the developer to form a toner image;

a primary transfer unit that primarily transfers the developed toner image onto an intermediate transfer member; and a secondary transfer unit that secondarily transfers the toner image transferred to the intermediate transfer member, onto a recording material.

15. The image forming apparatus according to claim 14, wherein a sheet conveying speed of the image forming apparatus is from 220 to 600 mm/sec.

16. The toner set for electrostatic image development according to claim 1, wherein:

the content of the red pigment is from 0.5 wt % to 4 wt %; and the content of each of the yellow and the magenta pigments is from 3 wt % to 12 wt %.

* * * * *